US006918160B1

(12) United States Patent
Clark

(10) Patent No.: US 6,918,160 B1
(45) Date of Patent: Jul. 19, 2005

(54) FOLD-UP MARINE FURNITURE COMPONENT WITH ARTICULATED BRACKET SUPPORT

(75) Inventor: Richard N Clark, Farmington Hills, MI (US)

(73) Assignee: Tecla Company, Inc., Walled Lake, MI (US)

( * ) Notice: Subject to any disclaimer, the term of this patent is extended or adjusted under 35 U.S.C. 154(b) by 0 days.

(21) Appl. No.: 10/161,316

(22) Filed: Jun. 3, 2002

Related U.S. Application Data

(60) Provisional application No. 60/295,861, filed on Jun. 6, 2001.

(51) Int. Cl.[7] ..... E05D 15/32
(52) U.S. Cl. ..... 16/370; 16/370; 16/368; 16/369
(58) Field of Search ..... 16/370, 368, 369

(56) References Cited

U.S. PATENT DOCUMENTS 4,558,901 A * 12/1985 Yokoyama ..... 297/113
5,096,152 A * 3/1992 Christiansen et al. .... 248/311.2
5,433,503 A * 7/1995 De Filippo ..... 297/115
6,213,546 B1 * 4/2001 Malusev et al. ..... 297/113

* cited by examiner

*Primary Examiner*—Suzanne Dino Barrett
*Assistant Examiner*—Mark Williams
(74) *Attorney, Agent, or Firm*—Reising, Ethington, Barnes, Kisselle, P.C.; William J. Waugaman

(57) ABSTRACT

A four-bar hinge linkage and fold-down support assembly, such as an armrest, seat bottom, table top and the like especially suited for marine use in watercraft applications. The support member is pivotally supported by first and second four-bar hinge linkages for articulation from a stationary upright support structure affixed to the watercraft. Each of the four-bar hinge linkages comprises a support-structure-mounting bracket, a main hinge link, a shorter control/locking link and a support-member-mounting bracket. Each of the linkages articulates the support member between an upright stored position and a folded-down in-use position wherein, the swinging end of the control/locking link swings up and beneath the hinge link so that an end edge of the control/locking link abuts in line-to-line contact at an abutment locking point along the lower edge of the hinge link, each linkage being thus locked together to form a triangular support truss. The abutment locking point placement provides a strong support structure, reduces the possibility of creating a pinch point and is oriented well forward of the linkage pivot point so that the links will not push by one another.

17 Claims, 11 Drawing Sheets

FOLD-UP MARINE FURNITURE COMPONENT WITH ARTICULATED BRACKET SUPPORT

This is a United States regular utility patent application filed pursuant to 35 U.S.C. §111 (a) and claiming the benefit under 35 U.S.C. §119 (e) (1) of U.S. provisional application Ser. No. 60/295,861 filed on Jun. 6, 2001 pursuant to 35 U.S.C. §111 (b).

FIELD OF THE INVENTION

This invention relates to fold-up furniture components and articulated bracket supports for the same, and more particularly to such fold-up components for marine use in the form of armrests and seat bottoms supported for movement between a horizontal load bearing position and a fold-up generally vertical stored position by an articulation linkage of the four-bar type.

BACKGROUND OF THE INVENTION

Automotive and recreational vehicle upholstered furniture, such as armrests and fold-down seat bottom supports, have long been provided with articulated linkages of the four-bar linkage type typically involving two angle piece mounting brackets, a hinge link and a control/locking link. For automotive applications, these linkage components are typically made out of steel by die stamping processes, and accordingly the die stamping tooling to make such parts involves a costly progressive die. The mounting brackets are often die formed from flat stock into a cross sectional L-shape to thereby form angle brackets, which in turn increases the cost of the part and the tooling. Accordingly, the construction hitherto provided and the process of manufacturing it for automotive and recreational vehicle use is not well suited to marine applications for these and many other reasons.

OBJECTS OF THE INVENTION

Accordingly, among the objects of the present invention are to provide an improved automotive style armrest and improved method of constructing the same, the armrest being of the fold-up upholstered type but suitable for marine use and with a support articulation by an improved hinge of the four-bar linkage type that (1) allows the armrest to be stored hidden in the backrest cushion of the upholstered seating; (2) can be pulled from a vertical or upright storage position out to a generally horizontal position where the armrest can be used to support the arm and elbow of the passenger seated on the associated marine seat; (3) which optionally can also serve as a cup holder; (4) is suitable for marine use and manufacturable with marine grade materials and finishes; (5) provides a four-bar linkage type articulation support that locks up in the folded-out horizontal position for arm support but which can be easily manipulated to rotate the armrest to the stored position; and is strong and durable and can meet the requirements of loading of the American Boat & Yacht Council (ABYC) H-31 seat structure standard.

Further objects are to provide an improved fold-up seat, table top or countertop construction for marine use, and improved method of constructing the same, that enables the seat bottom to be folded up and stored into a wall space and readily pulled from the stored position out to a horizontal position to provide comfortable seating with an upholstered seat bottom, thereby providing a space-saving in marine use and eliminating clumsy fold-down support legs, that enables the area behind the seat to be used for storage, and that can be constructed of marine grade materials and finishes and meets load testing standards of ABYC.

BRIEF DESCRIPTION OF THE DRAWING FIGURES

The foregoing as well as additional objects, features and advantages of the present invention will become apparent from the following detailed description, accompanying drawings and photoprint exhibits, as well as scaled engineering drawings, wherein.

Figure 13:
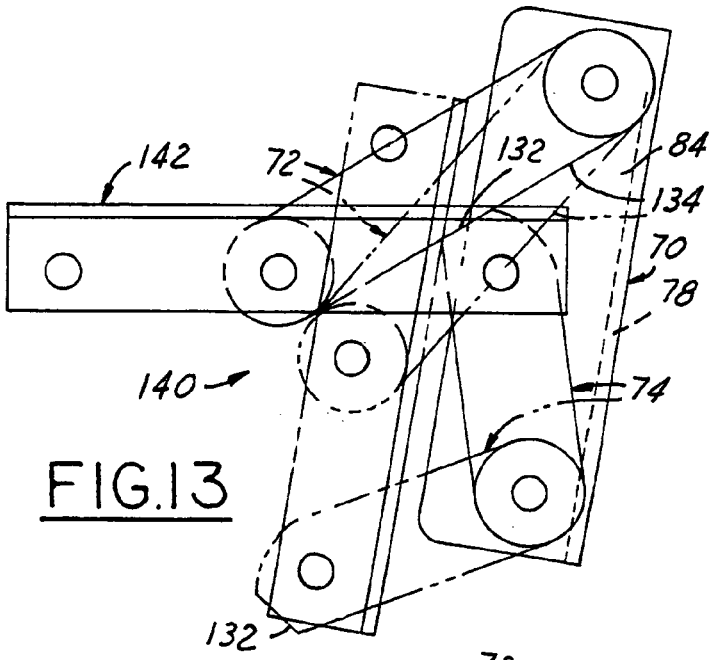
FIG. 13 is an engineering line drawing to scale of the starboard side one of the four-bar hinge assemblies of a second embodiment of the invention and illustrating by hidden lines and solid lines respectively both the folded up and folded down positions thereof.
Figure 15:
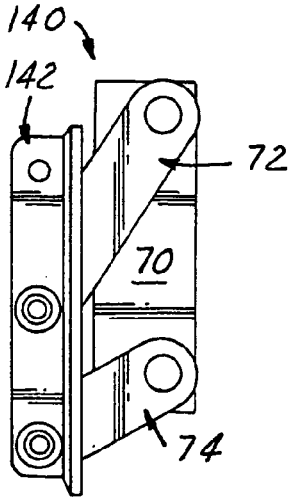
FIGS. 14 and 15 are side elevational views of the four-bar hinge assembly of FIG. 13 shown respectively in folded down and folded up condition corresponding to said positions illustrated in FIG. 13.
Figure 14:
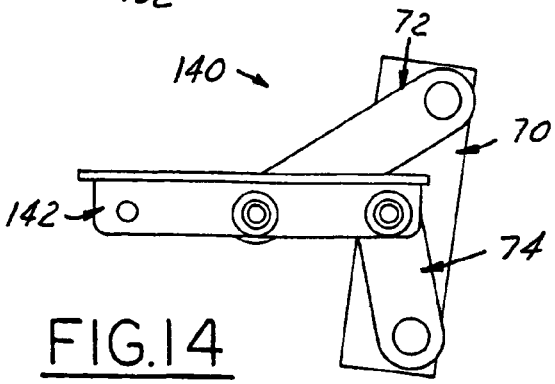
Figure 16A:
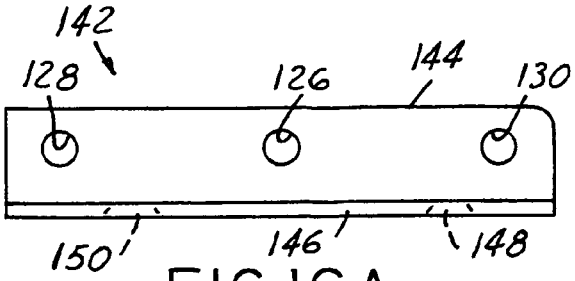
Figure 16B:
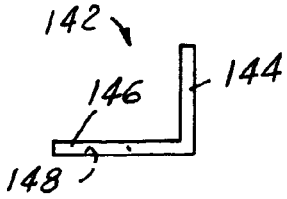
Figure 16C:
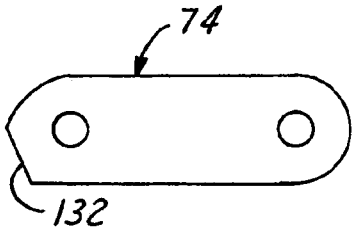
Figure 16D:
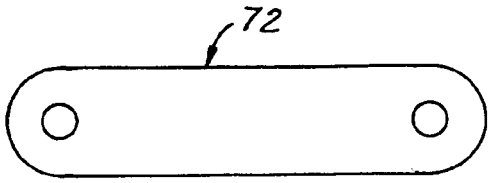
Figure 16E:
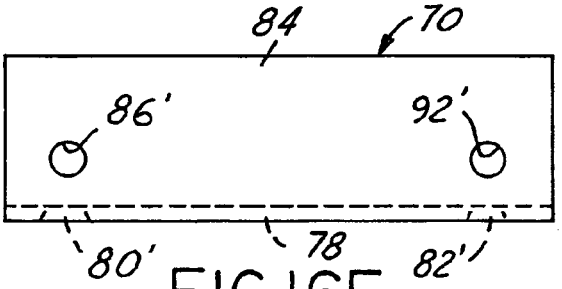
Figure 16F:
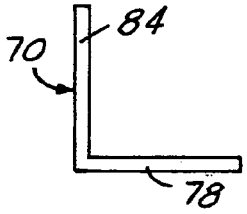

FIGS. 16-A and 16-B are respectively side and end views of the angle bracket of the four-bar hinge assembly of FIGS. 13–15 that attaches to the armrest framework.

FIGS. 16-C and 16-D are side elevational views of the control link and main hinge link respectively of the four-bar hinge assembly of FIGS. 13–15.

FIGS. 16-E and 16-F are respectively side and end views of the angle bracket of the four-bar linkage of FIGS. 13–15 that attaches to the stationary bench seat backrest support panel for the armrest.

Figure 17:
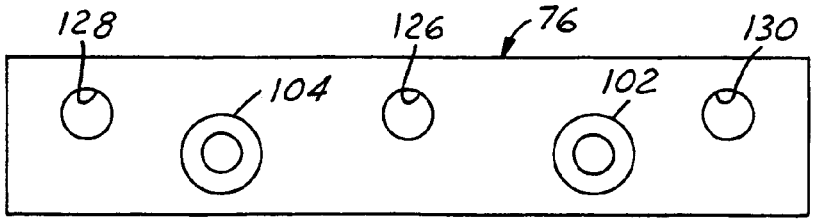

FIG. 17 is a CAD scaled engineering side elevational view of the armrest bracket of the four-bar armrest hinge assembly of FIGS. 4–12 that attaches to the armrest framework.

Figure 18:
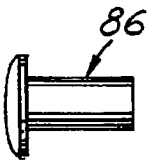

FIG. 18 is a side view of one of the hinge pivot rivets preferably employed in all of the four-bar hinge assemblies of the invention disclosed herein.

Figure 19:
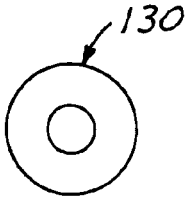

FIG. 19 is a plan view of one of the thin Mylar plastic washers preferably used on selected pivot points of the four-bar hinge assemblies of the invention in order to minimize friction.

Figure 20:
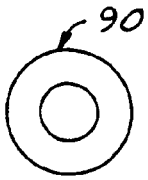

FIG. 20 is a plan view of one of the stainless steel back-up washers used in conjunction with the rivet of FIG. 18 in the pivot connections of the four-bar hinge assemblies of the invention.

Figure 21:
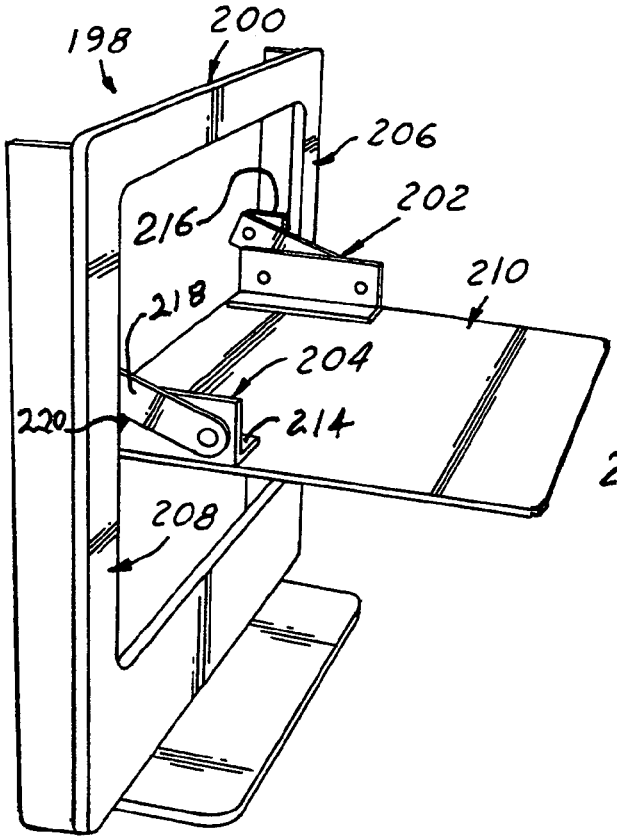

FIG. 21 is perspective view of a third embodiment of the invention in the form of a fold-up hidden seat prototype mock-up (unupholstered), facing forward of the watercraft, and associated four-bar hinge assembly articulation support for the same shown without upholstery and folded down from a frame mock-up to the horizontal sitting position of the seat.

Figure 22:
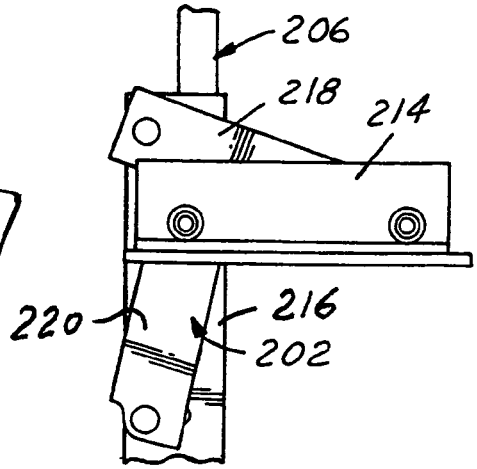

FIG. 22 is a side elevation of the port side one of the two hinge assemblies of the hidden seat embodiment of FIG. 21 shown in the folded down sitting orientation.

Figure 23:
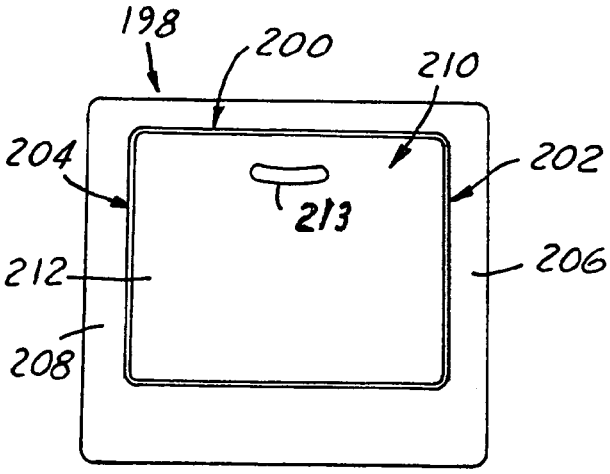

FIG. 23 is a front elevational view of the hidden seat of FIG. 21 as fully folded up.

Figure 24:
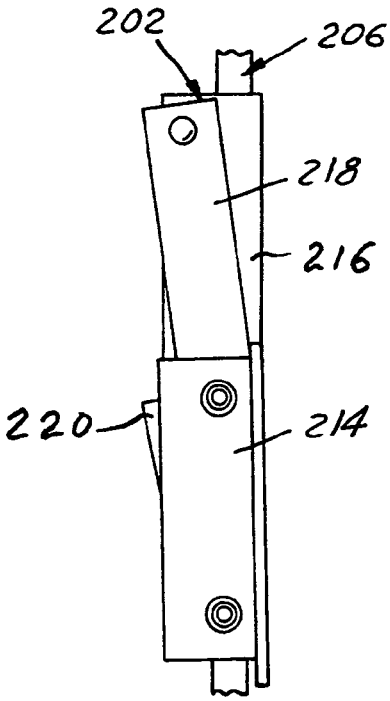

FIG. 24 is a view of the hinge assembly of FIG. 22 shown oriented in the completely folded up position corresponding to the seat condition of FIG. 23.

Figure 25:
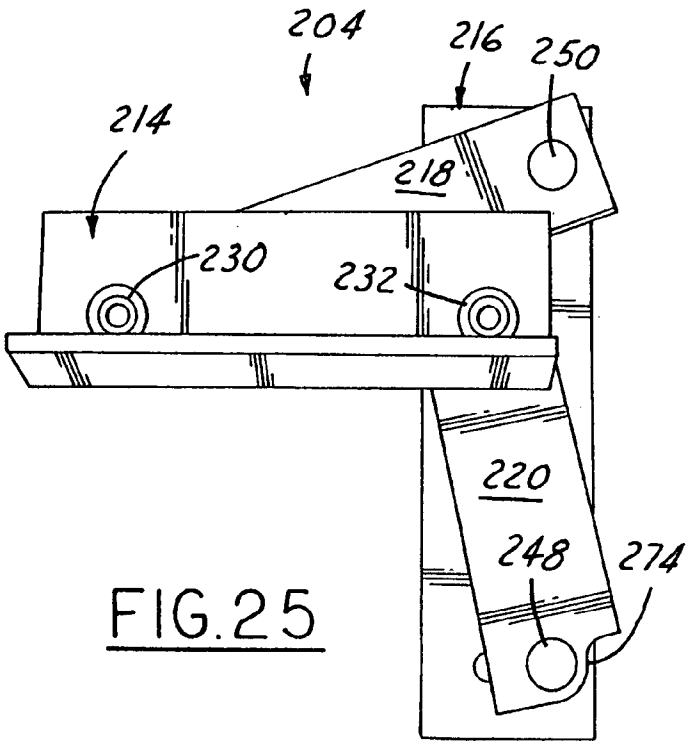

FIG. 25 is a view of the starboard side seat hinge of FIG. 21 shown in the seat folded down orientation as viewed from the port side thereof.

Figure 27:
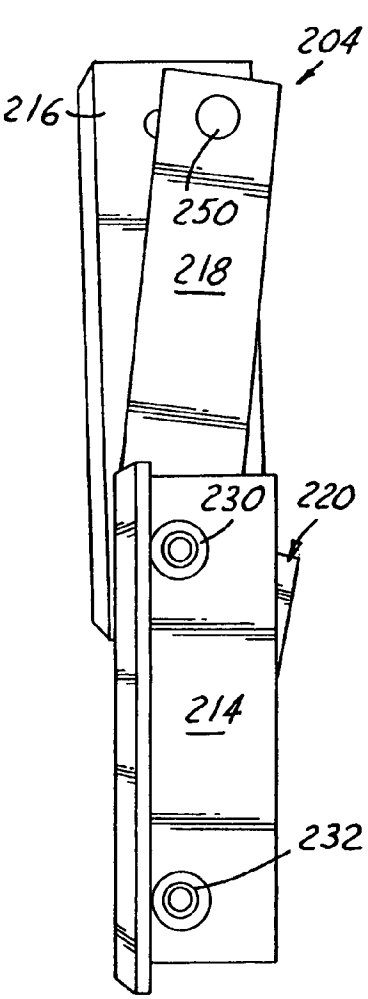
Figure 26:
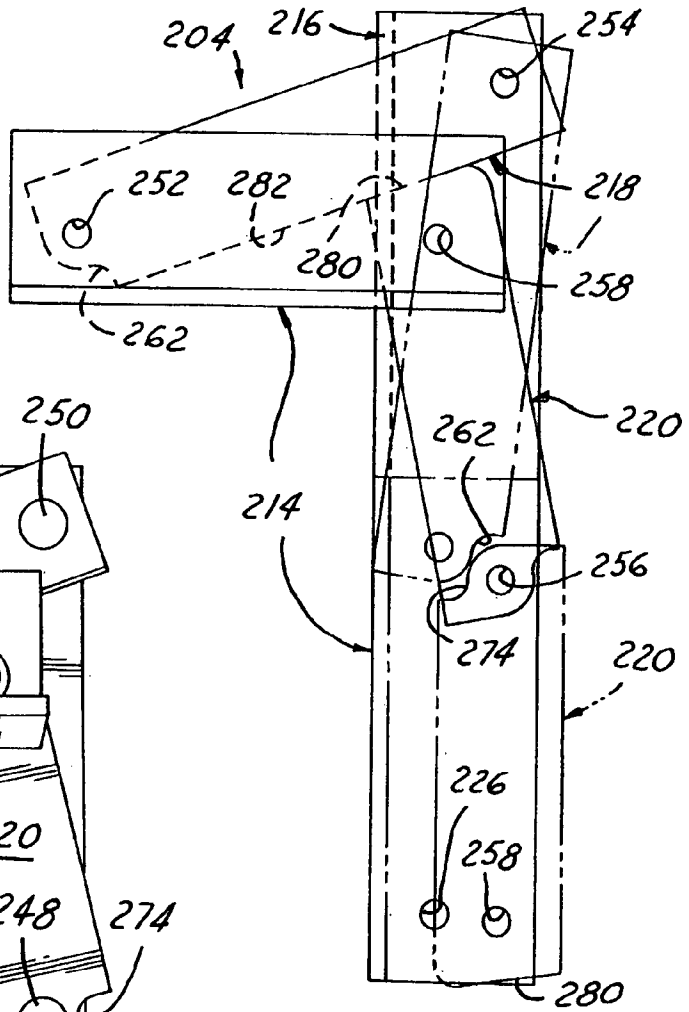

FIG. 26 is a CAD scaled engineering side elevational view of the hinge assembly of FIG. 25 illustrating the components in solid lines and hidden lines respectively in both their folded down seating condition of FIG. 25 and in the folded up, folded back seat-hidden condition of FIG. 27, the bottom right hand link as viewed in FIG. 26 being shown disconnected at its lowermost pivot point and repositioned toward the right to simplify detail.

FIG. 27 is a side elevational view of the hinge assembly of FIG. 25 shown in the seat folded up, seat-hidden condition.

Figure 29:
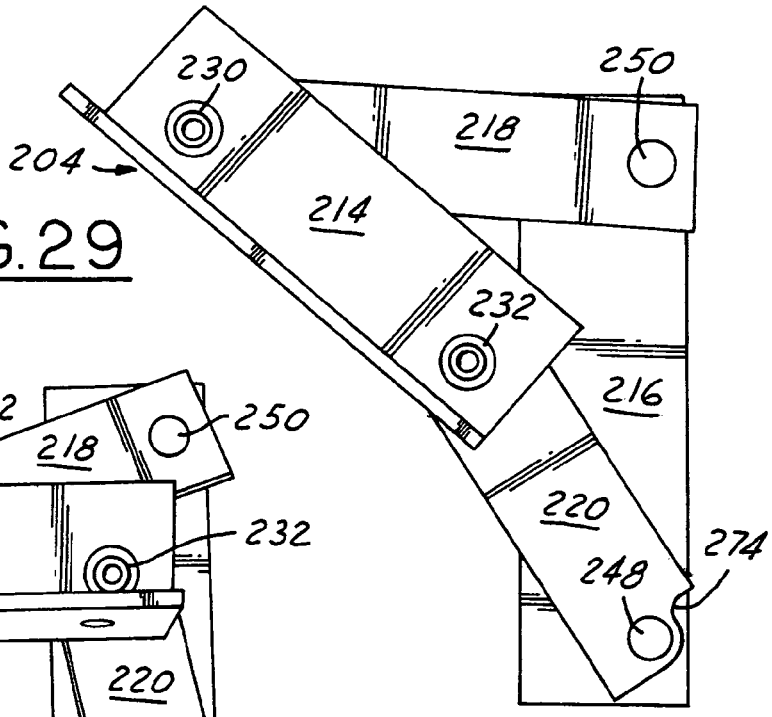
Figure 28:
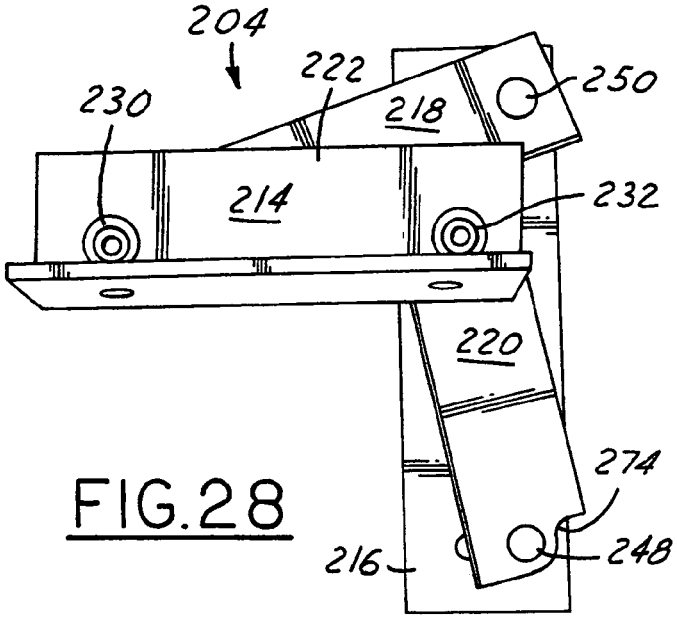
Figure 30:
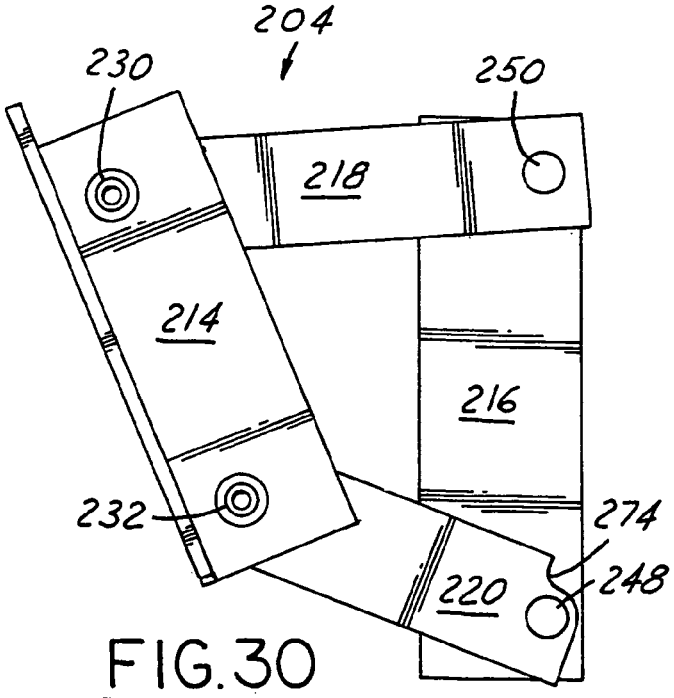
Figure 31:
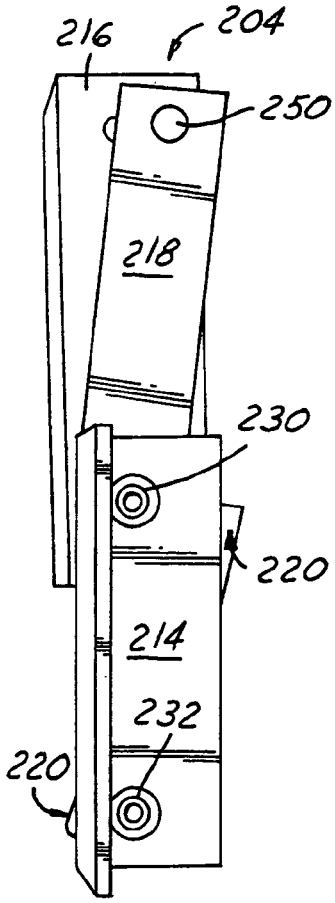
Figure 32A:
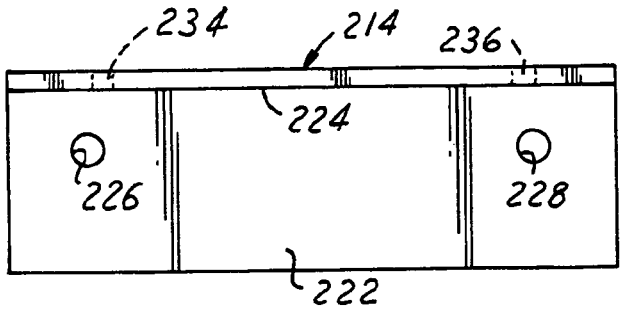
Figure 32B:
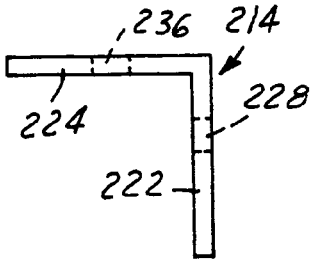
Figure 32C:
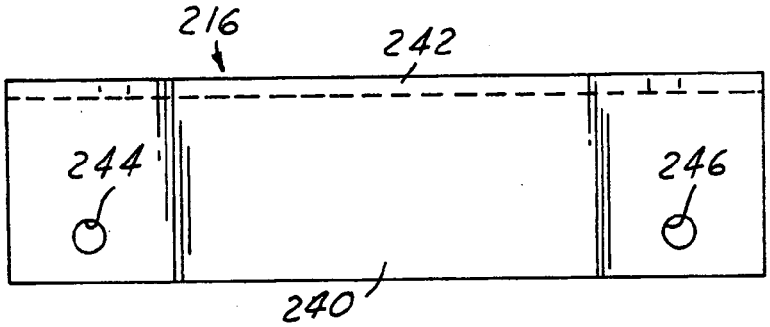
Figure 32D:
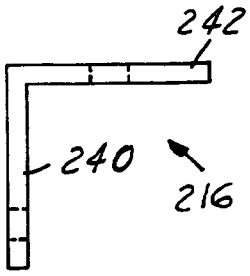
Figure 32E:
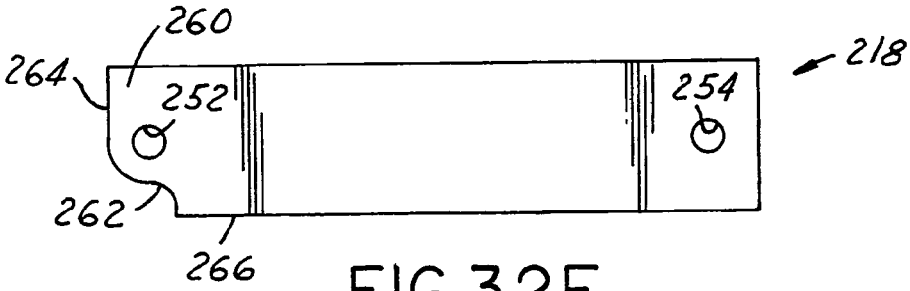
Figure 32F:
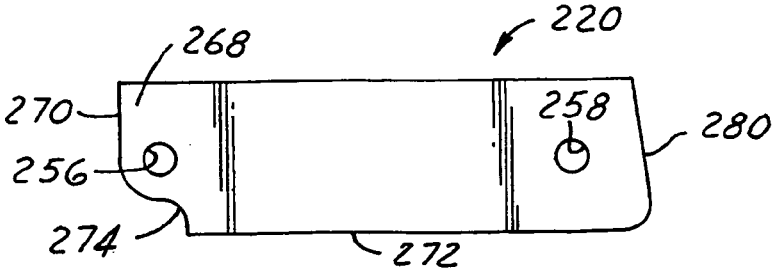

FIGS. 28–31 are sequential side elevational views of the hinge assembly of FIGS. 25–27 respectively shown in FIG. 28 in folded down position (duplicate of FIG. 25), in FIG. 29 initially partially swung toward folded up position, in FIG. 30 still further swung toward folded up position, and in FIG. 31 fully folded up.

FIGS. 32-A and 32-B are side and end elevational CAD scaled engineering views respectively of the seat bracket angle of the hinge assembly of FIGS. 21–31.

FIGS. 32-C and 32-D are respectively side and end elevational CAD scaled engineering views of the back panel mounting bracket angle of the hinge assembly of FIGS. 21–31.

FIG. 32-E is a side elevational CAD scaled engineering view of the hinge link of the hinge assembly of FIGS. 21–31.

FIG. 32-F is a side elevational CAD scaled engineering view of the control or lock link of the hinge assembly of FIGS. 21–31.

Figure 34:
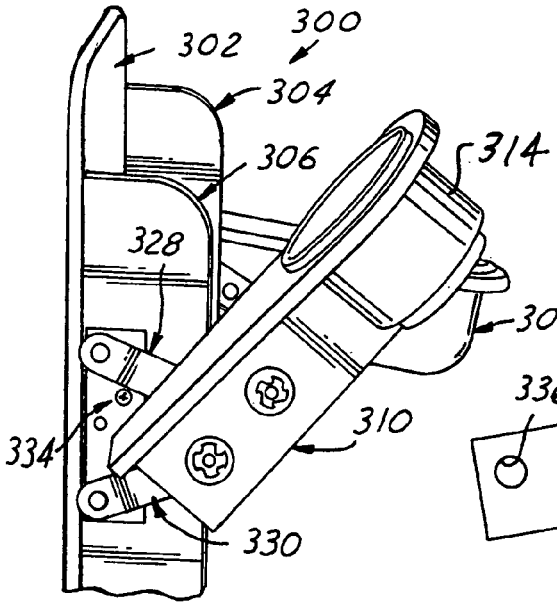
Figure 33:
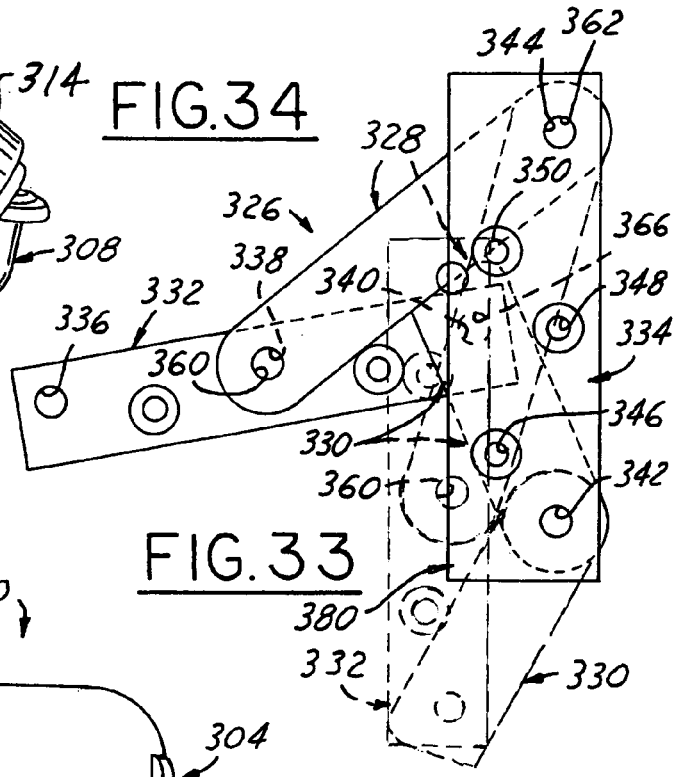
Figure 35:
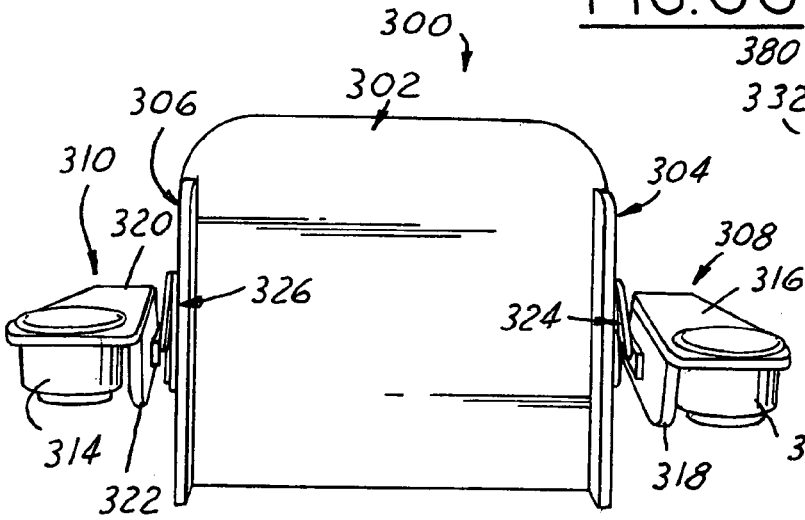
Figure 36:
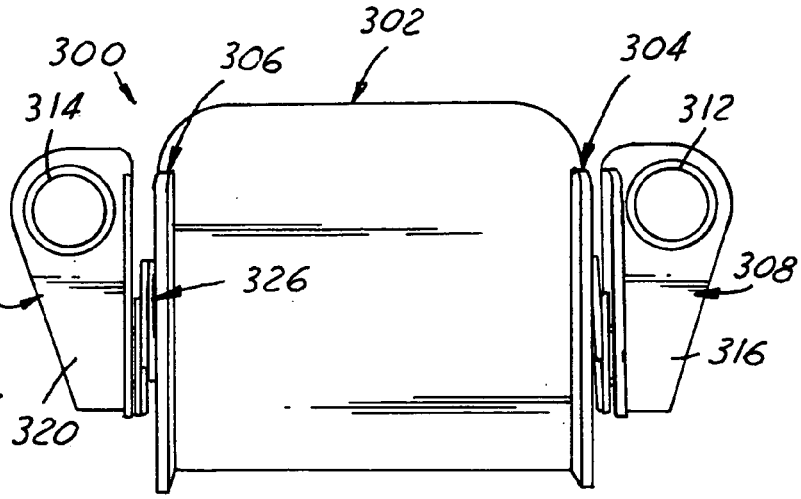

FIG. 33 is an engineering line drawing to scale of the starboard side one of the pair of four-bar hinge assemblies employed in the fourth embodiment seat assembly of the invention shown in FIGS. 34–36.

FIG. 34 is a perspective view of the side of the seat assembly of the fourth embodiment illustrating the starboard armrest frame folded up half-way between horizontal folded-out and fully raised stowed positions, the port side armrest frame being shown in the fully folded-down position behind the starboard armrest.

FIG. 35 is a front elevational view of the seat assembly of FIG. 34 illustrating the armrest frames folded down in their arm-resting positions and articulated for pivotal support by the modified four-bar linkage hinge assemblies that are coupled between the armrest frames and the side wings of the seatback of the seat assembly.

FIG. 36 is a front elevational view similar to FIG. 35 but with each armrest frame folded up to their completely stowed position.

Figure 37:
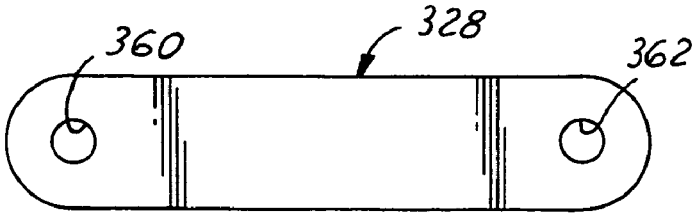
Figure 38:
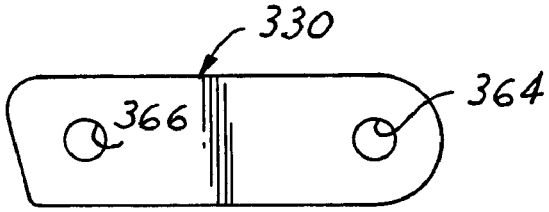
Figure 39:
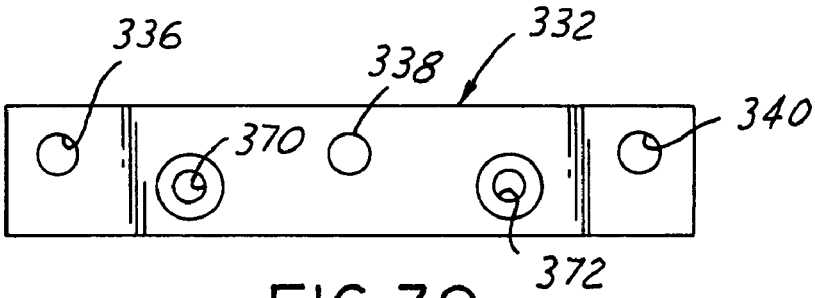
Figure 40:
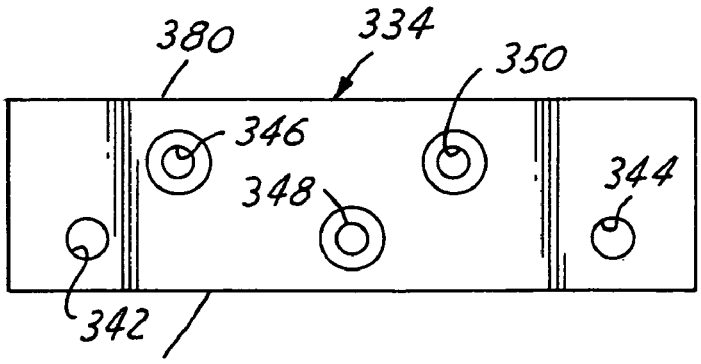

FIGS. 37–40 are engineering detail plan views of the two links and two brackets of the four-bar hinge assemblies employed in the modified fourth embodiment seat construction of FIGS. 34–36 and shown separately by themselves; FIG. 37 showing, in side elevation, the long hinge link, FIG. 38 showing the short control link, FIG. 39 showing the armrest-mounting bracket, and FIG. 40 showing a seat-mounting bracket.

Figure 41:
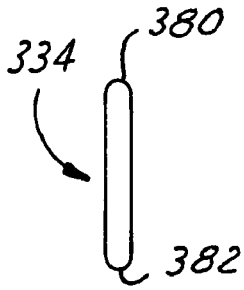

FIG. 41 is an end elevational view of the seat-mounting bracket shown in FIG. 40.

PRIOR ART

Figure 1:
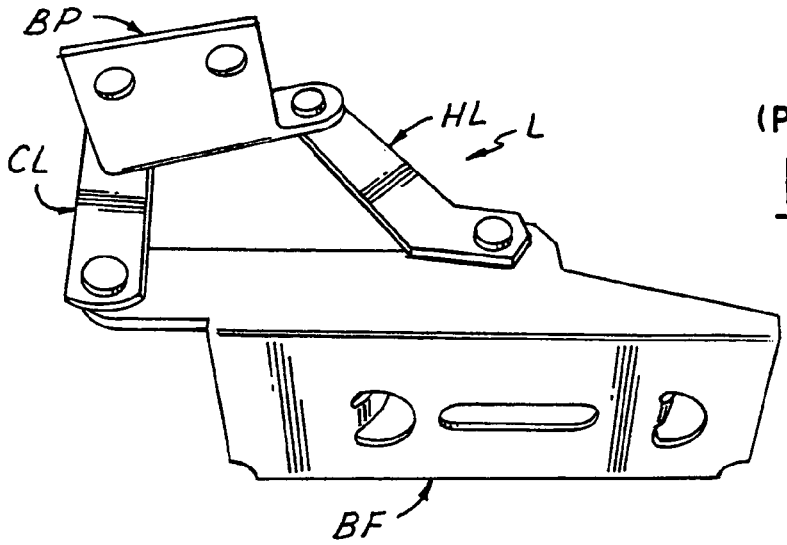
(PRIOR ART) FIG. 1
FIG. 1 is a perspective view of a prior art automotive style four-bar linkage armrest support hinge.
Figure 2:
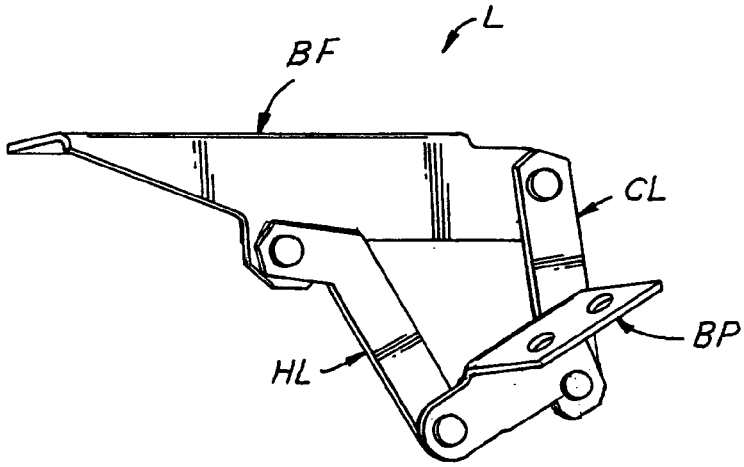
(PRIOR ART) FIG. 2
FIGS. 2 and 3 are additional perspective views of the hinge of FIG. 1 taken from different perspective angles to provide a more complete view of the structure of the automotive hinge of FIG. 1.
Figure 3:
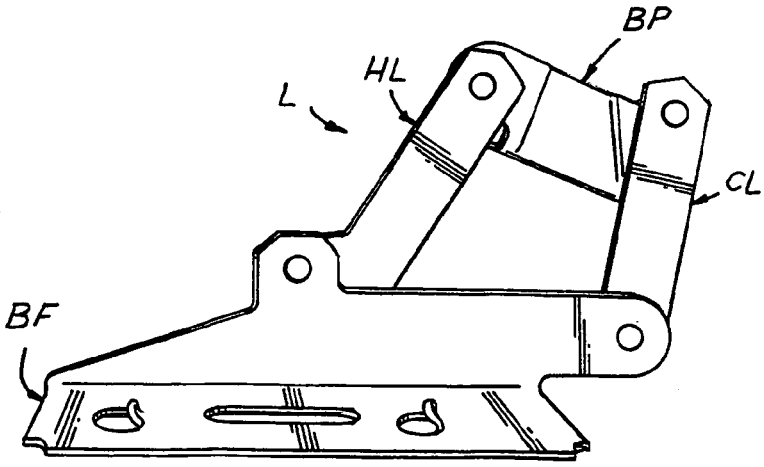
(PRIOR ART) FIG. 3

FIGS. 1, 2 and 3 illustrate a prior art automotive style armrest four-bar hinge assembly such as that employed with a rear seat armrest that enables the armrest to be folded up and stored in the seatback and then folded out so it can be used as an armrest and/or cup holder. The hinge assembly consists of a four-bar linkage L made up of two angle piece mounting brackets BP and BF that fasten respectively to an associated seatback support panel (not shown) and to an associated armrest frame (not shown). These mounting brackets are pivotally connected together by two straight links, one being a hinge link HL and the other a control/lock link CL. Both of the angle brackets are made from heavy sheet steel that is progressively die blanked, stamped and then bent in expensive progressive die tooling. The pivot points are typically special cold-headed rivets. No washers are provided with the rivet heads, nor are there any spacer washers employed in this automotive four-bar armrest hinge assembly. Each of the angle bar components have through holes, edge variations, and offset portions in their major planes that render these parts a custom design manufacturable only with expensive and costly progressive die tooling if the same are to be manufactured on a mass production basis. For these and other reasons the automotive armrest four-bar hinge assembly of FIGS. 1–3 is entirely unsuitable for use in marine environment applications.

DETAILED DESCRIPTION OF PREFERRED EMBODIMENTS

First Embodiment

FIGS. 4–12 illustrate the first embodiment of a four-bar hinge assembly and fold-down support member in the form of an armrest in this embodiment as invented by the named inventor herein for marine use in watercraft seating applications, typically a powerboat of the speedboat or cabin cruiser type. The armrest 40 shown by way of example herein consists of a frame 50 (FIGS. 8 and 9) made up of a platform board 52 and two laterally spaced sideboards 54 and 56 dependent therefrom with their longitudinal dimension running parallel to that of platform 52 and being slightly inset from the lateral side edges 58 of board 52. Preferably the material of the platform 52 and sideboards 54 and 56 is an extruded polymer foam or the like and therefore not subject to the adverse influences of rot or corrosion.

Frame 50 is pivotally supported for four-bar hinge articulation from a stationary upright back panel board 60 of the boat bench seat or sofa 62 seen in FIGS. 4–7. This articulation is provided by means of a starboard and a port four-bar hinge assemblies 64 and 66 respectively, both being seen in FIG. 5, starboard hinge assembly 64 being seen only in FIGS. 4, 8 and 9, and port hinge assembly 66 being only that shown in FIGS. 10–12. ("Port" and "starboard" as used herein assume that bench seat or sofa 62 is a forward facing seat in the watercraft).

Figure 8:
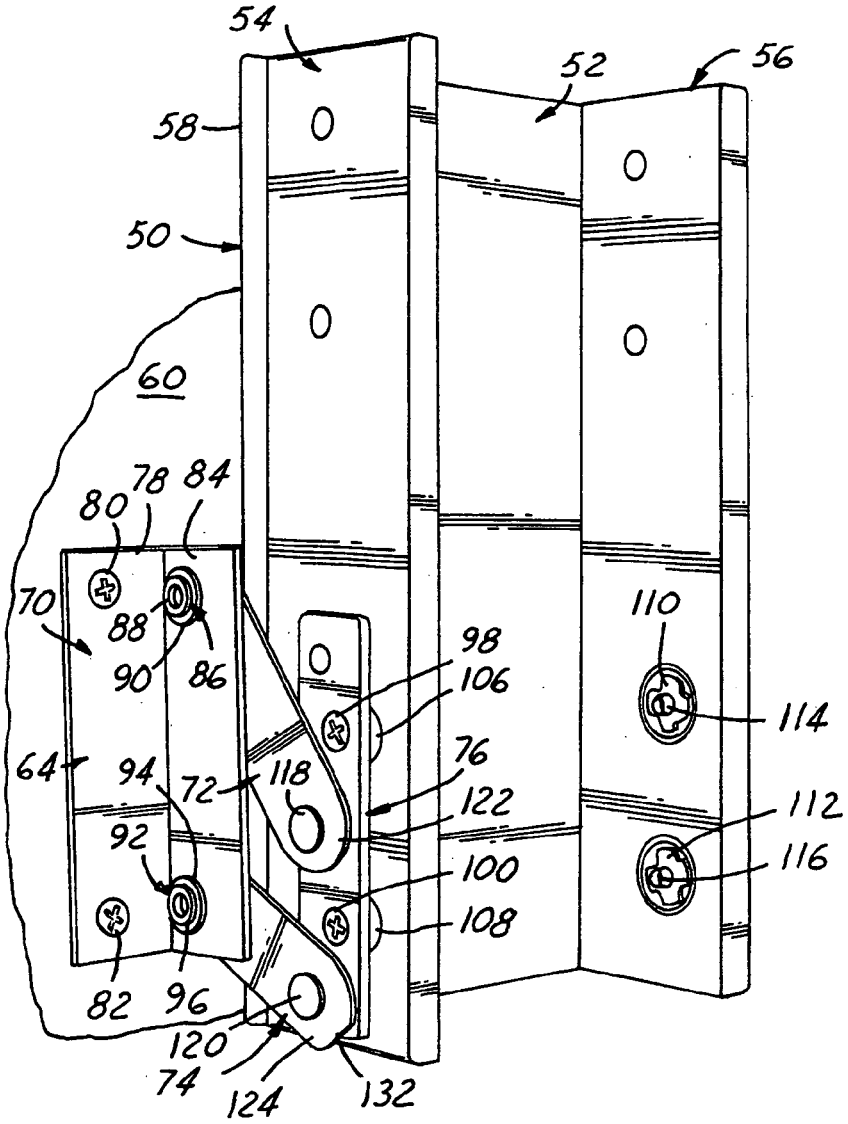
FIG. 8 is a perspective close-up view of the armrest structure of FIGS. 4–7 showing the armrest framework in folded-up stored position and without upholstery, and illustrating the starboard side one of the two four-bar hinges connected between the framework and the bench seatback supporting panel for the armrest.

Each of the hinge assemblies 64 and 66 of the first embodiment consists of a four-bar linkage made up of a right angle bracket 70, a main hinge link 72, a shorter control and locking link 74 and a mounting bracket bar 76. As best seen in FIG. 8, right angle mounting bracket 70 has one of its rectangular flanges 78 secured by two Phillips head screws 80 and 82 to seatback panel 60. The other flange 84 of angle bracket 70 provides a stationary pivot mount for one end of hinge link 72, the pivot pin for this connection being a standard stainless steel rivet 86 cold-worked to form a peen end 88 overlying a backup washer 90 (FIG. 8). Rivet pin 86 is seen by itself prior to installation in FIG. 18. Washer 90 appears in FIG. 8 and well as by itself in FIG. 20. Bracket flange 84 also provides a stationary pivot mount for the one end of the # control/locking link 74, a rivet pivot pin 92, identical to pin 86, providing this pivot connection for link 74, and an associated backup washer 94 identical to washer 90 underlying the peen end 96 of rivet pivot pin 92.

Armrest bracket 76 of hinge assembly 64 is secured to the outboard side of the starboard sidewall 64 of frame 50 by two stainless steel Phillips head mounting screws 98 and 100 that pass through countersunk holes 102 and 104 in bar 76 (FIG. 17), and thence through plastic spacer washers 106 and 108 (FIG. 8; optional items), thence through pre-formed holes in sidewall 54 into a pre-mounted standard T-nut. Two of such T-nuts 110 and 112 are seen in FIG. 8 receiving the threaded shanks 114 and 116 of the mounting screws for the port side hinge assembly mounted to the outer side of the port sidewall 56 of frame 50.

Armrest bracket 76 provides the pivot connection of links 72 and 74 to the armrest frame 50 by means of pivot pin rivets 118 and 120 passing respectively through holes in the swinging ends 122 and 124 of links 72 and 74 respectively. Rivets 118 and 120 pass through holes 126 and 128 in link 76 (FIG. 17). A third hole 130 is provided in link 76 that is not used in the functioning of starboard hinge assembly 64, but is provided for the purpose of rendering the link a common part for use in both port and starboard hinge assemblies 64 and 66. When link 76 is used in the port hinge assembly 66 it is reoriented by flipping it over, i.e., rotating it about its longitudinal axis 180°, and then rotating it end for end, i.e., rotating it 180° about a central axis perpendicular to the major plane of the link. Then holes 126 and 130 become the holes for the corresponding pivot pins 118 and 120 for the corresponding links 72 and 74 of port hinge assembly 66. The peen ends of rivet pivot pins 118 and 120 are identical to peen ends 88 and 96 of rivet pins 86 and 92, but are not seen in FIG. 8.

A pair of washers 90 may be employed to take up the extra spacing between the peen end of the rivet head and the port side of bracket 76 when using pivot pins 86 all of the same length and diameter. Two washers 90 are sleeved on rivet pins 86 and 92 between bracket flange 84 and the associated links 72 and 74 in order to space these links sufficiently from the port side of flange 84 to allow swinging clearance for the heads of rivet pins 118 and 120. Thin Mylar washers 130 (FIG. 19) are sleeved one apiece on rivet pins 118 and 120 between links 72 and 74 and armrest bracket 76 to reduce rubbing friction and wear between these links and the armrest bracket.

Figure 10:
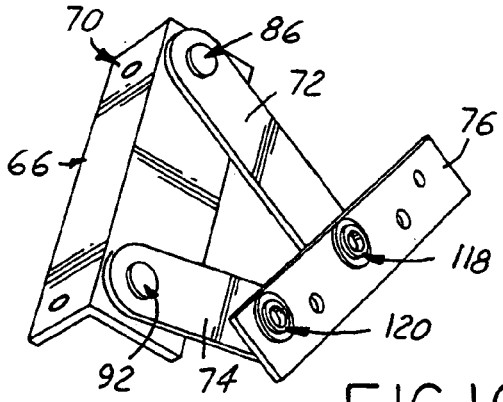
FIGS. 10, 11 and 12 are perspective views from different perspective angles of the port side one of the four-bar hinges of the armrest of FIGS. 4–9.
Figure 11:
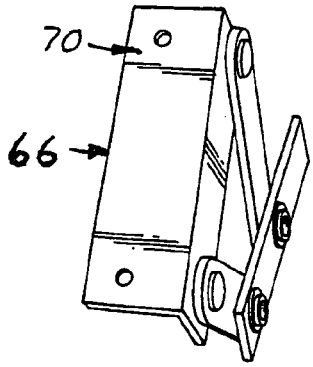
Figure 12:
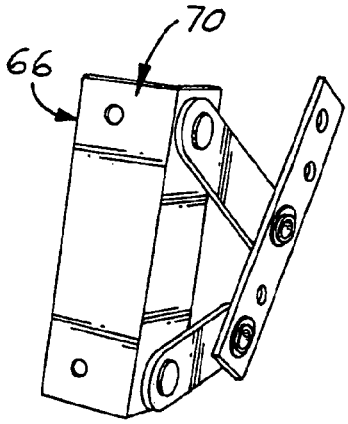

As will be seen from FIGS. 10, 11 and 12, the port side hinge assembly 66 is identical but reversed relative to hinge assembly 64, and uses the identical parts consisting of hinge link 72, control/locking link 74 and armrest bracket bar 76, the symmetry of the linkage parts enabling this starboard to port transposition and reorientation.

In accordance with the invention, the two links 72 and 74 are preferably made from standard aluminum bar stock that is preferably 0.125 inches thick and 1 inch wide. The mounting angle bracket 70 is made from standard aluminum extruded angle bar stock preferably 0.125 inches thick and with equal flange widths of 1.5 inches. The armrest bracket bar 76 is a standard aluminum flat bar stock piece likewise preferably 0.125 inches thick and 1 inch wide. Preferably these standard aluminum extrusion parts are powder-coat painted to further resist corrosion in a marine environment. The lubricity of a powder coat paint finish over non-anodized aluminum material makes the linkage and pivot points work smoother and quieter than, for example, even when the hinge assembly parts are constructed of uncoated but anodized aluminum. If desired, the powder coat paint also may be applied over an anodized aluminum finish on the hinge parts.

The pivot pins 86, 92, 118 and 120 are all identical and are preferably standard 5/16 inch diameter stainless steel rivets, the stainless steel backup washers 90 being strategically placed to provide sufficient strength and to eliminate rubbing of the moving parts of the hinge assembly. Bracket parts 70 and 76 and the link parts 72 and 74 are preferably die punched to form the through-holes located in precision relationship and spacing as shown in FIGS. 13, 16-A–16-F and 17 by utilizing unit punch tooling. Where curved edges, chamfering and countersinking are required, readily available CNC machining can be employed, and also used in drilling through-holes as an alternative to die-punch unit tooling. Thin plastic washers 130, either made of polyester or Mylar material, are used on the pivot points to minimize friction.

As will be seen from FIGS. 4–7, the hinge assemblies 64 and 66 are mounted in and move closely adjacent the armrest and bench seat upholstery. The goal is to have as little gap as possible between the seatback cushions of bench seat 62 that flank armrest 40 and the upholstery of the armrest adjacent thereto in the folded up condition of FIGS. 5 and 7. It will be seen that the foregoing design and construction of hinge assemblies 64 and 66 accomplish this goal.

In order to comply with seat standard H-31 of the American Boat and Yacht Council, armrest 40 must be able to withstand a 125 lb. static load applied at any point on the armrest. Brackets 70 and 76 and links 72 and 74 constructed in accordance with the foregoing exemplary specifications, together with the relatively large diameter of their stainless steel rivet pins 86, 92, 118 and 120, readily satisfy or comply with this requirement, and the oversize nature of the pivot pins renders the assembly more durable.

Figure 9:
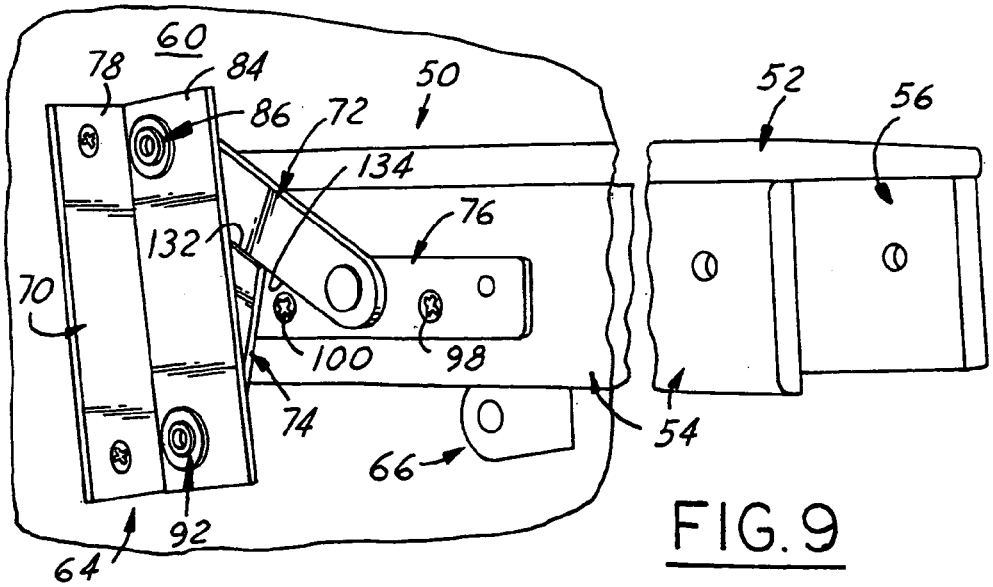
FIG. 9 is a fragmentary perspective view showing the unupholstered armrest of FIG. 8 folded down to the in-use generally horizontal position.

The four-bar hinge assemblies 64 and 66, in articulating armrest 40 between the upright stored position (FIGS. 5 and 7) and the folded-down in-use position (FIGS. 4 and 6), operate in a manner similar to the prior art hinge of FIGS. 1–3. That is, in the folded-out position of the armrest (FIG. 9), the control/locking link 74 and its swinging end 124 swings up and beneath link 72 so that in the fully folded-down position of FIG. 9, an inclined end edge 132 of link 74 abuts, in line-to-line contact, the underside edge 134 of link 74, as seen in FIG. 9. In this condition, the linkages are locked together to form a triangular truss. The placement of the locking point is critical so that the linkage is locked together at a point where they are strong, do not create a pinch point and are well forward of the linkage pivot point so they will not push by one another. This locking point relationship is best seen in FIG. 13, as well as in FIGS. 26 and 33 referenced hereinafter respectively in connection with the second, third and fourth embodiment hinge assemblies of the invention.

More particularly, with respect to preventing user/operator finger pinching when lowering the armrest, note in FIG. 13 how the line-to-line abutment of the straight abutment edge 132 of control link 74 is at least about 50% overlapped by flange 84 of hinge bracket 70. Since flange 84 is on the side of the four-bar linkage adjacent the user, it thus serves as a protective cover or finger barrier shield during final closure of link edge 132 into abutment with the lower edge 134 of hinge link 7. Hence an operational pinch point is avoided while also satisfying the other aforementioned criteria of lock-up strength and linkage stability in the fully lowered, load bearing condition of the armrest.

Another feature unique to the first embodiment is the use of a straight bar armrest mounting bracket 76 instead of an angle bracket. This design cooperates with the provision of a unique method of the invention involving mounting of each hinge assembly 64 and 66 to the armrest that reduces the cost of installation of the hinge assembly to the armrest and overall cost of assembly of the armrest. Providing armrest hinge bracket 76 as a straight bar link and through-bolting it to the armrest frame 50, but not until after upholstering the same, simplifies the armrest upholstering and assembly procedure to thereby lower the manufacturing cost of the armrest assembly 40. The mounting method thus features using the straight link mounting bracket 76 in the hinge assembly instead of an angle bracket, and attaching port and starboard links 76 to the upholstered frame sidewalls 54 and 56 with the two sets of screws 98, 100 and 112, 114. Suitable access holes can be punched or cut in the upholstery to allow the screws 98, 100, 112, 114 to pass into and through their pre-formed mounting holes in sidewalls 54 and 50 and then thread into their associated pre-mounted T-nuts. The seat mounting bracket screws 80 and 82 can be attached to their mounting surface points on back panel 60 before or after attaching to the hinge assemblies 64, 66 to the upholstered armrest 40.

Preferably before this subassembly is made up, i.e., the subassembly of the upholstered armrest frame 50, and before the two armrest assemblies (starboard and port), are mounted thereto, any remaining upholstery cushion(s) in the dual layered armrest 40 seen in FIGS. 4–7 is then attached with cup holders 41 and 43 installed therein, and the armrest thus fully upholstered. Then the complete hinge subassemblies 64 and 66, i.e., with mounting angle bracket 70 and the armrest mounting bracket 76, and the two links 72 and 74 pivotally attached thereto as described hereinabove, are mounted to frame 50 utilizing mounting screw pivot pins, also made of stainless steel with stainless steel washers and locking nuts substituted for the rivet pivot pins 118 and 120. The flat bar mounting bracket 76 thus allows surface mounting of each pre-assembled hinge assembly to the armrest after the armrest is upholstered. This also allows the armrest frame 50 and backrest panel 60 to be pre-upholstered separately from one another at different facilities, if desired, and then married up at final assembly, thereby further reducing overall labor costs in seating construction and installation.

By contrast, prior art armrest mechanisms used an angle bracket instead of the straight bar bracket 76 to mount the hinge assembly to the armrest. This required that the armrest bracket angle be attached before the armrest assembly was fully assembled and upholstered. It also required that the armrest assembly be made in sections so that the armrest angle brackets could be attached. This, in turn, of course required more labor and cost than mounting with the straight bar bracket 76 as described hereinabove.

From the foregoing description, it will thus be seen that the first embodiment armrest 40 articulated from seatback panel 60 by the four-bar hinge assemblies 64 and 66 is well designed for the marine environment by utilizing marine-grade non-corrosive and water-resistant coatings, typically powdered-coat paint, and non-rusting material such as aluminum alloys readily available as standard stock extrusions and commercially available standard stainless steel rivet pins, washers and plastic shim washers. The design thus is unique in that it can use common lower cost materials, typically common straight aluminum bar stock and common aluminum angle stock, as well as standard rivet fasteners. Hence the high cost of progressive die tooling and custom fasteners is avoided. Instead the components of the four-bar hinge assembly armrest of the invention require only low cost tooling in their manufacture. Typically, radiuses are provided where needed on the linkages by radius cut die punched tooling for the ends. Unit punch tooling can be utilized for precision punching of the holes in the links and brackets of the hinge assembly. Or, as required, CNC machining can be employed which, in any event, provides for manufacture at a much lower tooling cost and equipment than progressive stamping dies.

Figure 4:
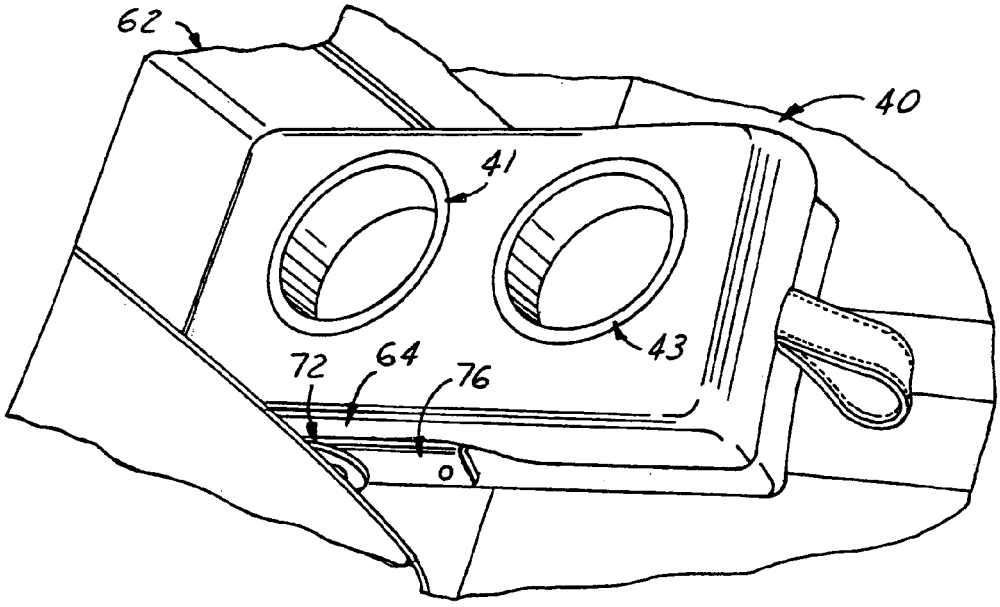
FIG. 4 is a perspective view of a first embodiment of the invention in the form of a finished marine armrest shown in folded down position for supporting the arm of a passenger riding on the associated forward-facing bench seat and provided with two cup holder inserts.
Figure 6:
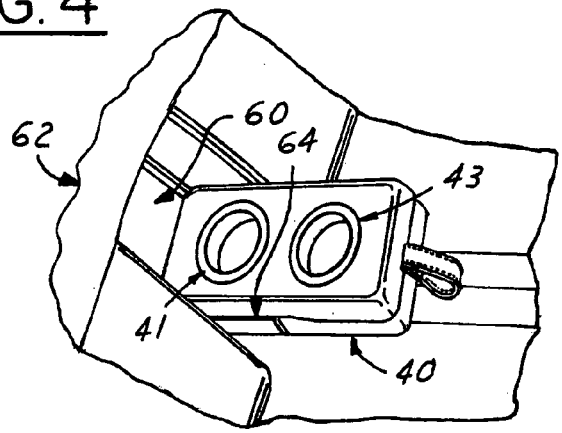
FIG. 6 is another perspective view similar to FIG. 4 but on a smaller scale, of the armrest in folded-down, in-use position.
Figure 5:
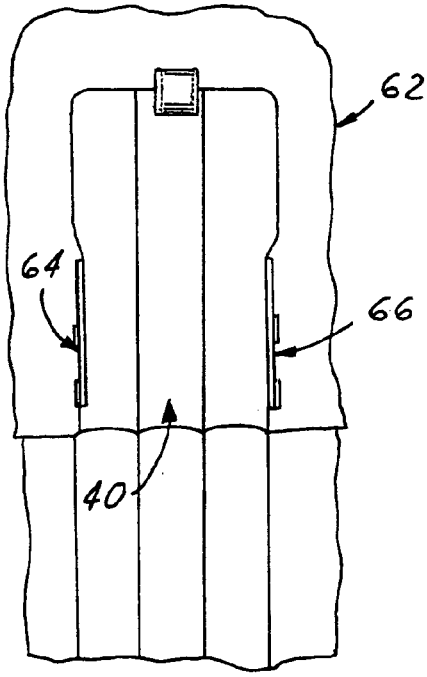
FIG. 5 is a perspective view in front elevation of the armrest of FIG. 4 shown folded up in a stored position in the seatback of the associated marine bench seat.
Figure 7:
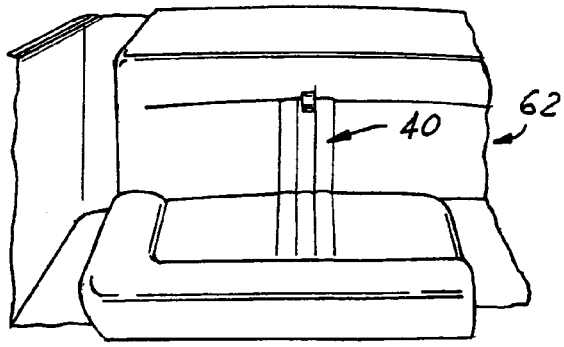
FIG. 7 is a perspective view in front elevation of the armrest as shown in the FIG. 5 position, but on a smaller scale and showing more of the associated seat bottom and back marine bench seating.

It will also be noted from FIGS. 4, 6 and 9 (and likewise, FIG. 13) that the point where the locking link 74 abuts the longer hinge link 72 is positioned as far forward in the swing arc as possible so that the links will not push by each other. Nevertheless, the point where the links meet, i.e., surface 132 abutting link edge 134 (FIG. 9), is placed so that it is not accessible to the user-occupant and thus avoids a pinch point for fingers of passengers when moving the armrest from stored to folded-down position and vice versa.

Second Embodiment

A second embodiment of the four-bar armrest hinge assembly 140 of the invention is illustrated in FIGS. 13, 14 and 15, wherein the second embodiment hinge assembly 140 is shown oriented for mounting and use as the starboard one of the pair of hinge assemblies. The only difference between hinge assembly 140 and hinge assemblies 64, 66 is the substitution of an angle armrest mounting bracket 142, constructed as shown in detail in FIGS. 16-A and 16-B, for the straight bar armrest mounting bracket 76 of hinge assembly 64, 66. The remaining parts and operational layout relationship are identical and therefore like reference numerals are applied in their description not repeated. As best seen in FIGS. 13-A, 16-A and 16-B, armrest mounting bracket 142 comprises a standard angle extrusion made of aluminum preferably having a 1 inch wide flange 144 that is provided with three link pivot connecting holes 128, 126 and 130 dimensioned and spaced in the same relationship as these holes are in straight bar link 76 described previously. The third hole thereby renders the armrest bracket 142 reversible for port and starboard hinge assemblies and thus a universal part, like link 76. The other flange 146 of angle bracket 142 is provided with two chamfered mounting holes 148 and 150, as shown in FIGS. 16-A and 16-B, for receiving mounting fasteners therethrough for attachment to the horizontal main panel of an armrest framework similar to panel 52 of framework 50.

The second embodiment armrest four-bar hinge assembly 140 thus enables the various features of the invention to be provided in an increased number of mounting variations, one being with the angle bracket 70 and straight link 76 of the first embodiment hinge assemblies 64 and 66, and the other being with the second embodiment with the two angle brackets 70 and 142. However, the second embodiment hinge assembly 140 does not provide the advantage of the first embodiment hinge assemblies 64 and 66 from the standpoint of allowing the armrest assembly to be made and fully upholstered before attaching the four-bar locking hinge assemblies 64, 66 thereto.

It will be seen that the engineering views of FIGS. 16-A through 16-F are drawn to scale, and these views as well as the engineering dimensions scalable therefrom, are incorporated herein by reference to facilitate construction of a preferred but exemplary successfully working prototype four-bar hinge assembly of the invention for use in the second embodiment. The first embodiment components are likewise drawn to engineering scale as to components 70, 72 and 74 as shown in FIGS. 16-C through 16-F, and the mounting bar 76 scalable from FIG. 17 are likewise incorporated herein by reference. Further dimensional scaling is illustrated in FIG. 13 and also are incorporated herein by reference.

Third Embodiment

As exemplified by a third embodiment of the present invention illustrated in FIGS. 21 through 32-F, it is possible and indeed readily feasible in accordance with the present invention, to scale up the armrest bracket mechanism of the foregoing second embodiment and also modify the mechanism so that it can be used for support articulation of a support member in the form of a pivotal boat seat assembly 198. In particular, as illustrated in FIGS. 21 and 23, this enlargement and modification of the four-bar hinge assembly of the invention is advantageously employed to make a pivotal seat that advantageously becomes a hidden seat mechanism 198. The thickness of the metal stock, i.e., the standard aluminum extrusions, is preferably increased from ⅛ inch to 3/16 inch in order to carry the greater load of seating use. A boat seat has to withstand a 450 lb. static load at each seated position pursuant to ABYC H-31 standard. It is even possible that a seat bracket would have to support a bench seat in any one of three seated positions. The mechanism of the invention is well capable of meeting these stringent load requirements.

FIGS. 21 and 23 illustrate a hidden seat prototype mock-up in which a surrounding seat frame 200 (assuming a forward facing orientation) in the associated watercraft has port and starboard four-bar hinge assemblies 202 and 204 mounted to the inside (aft) facing surfaces of the port and starboard uprights 206 and 208 respectively of frame 200. The hidden seat main platform 210, in the fully lowered seating position of FIG. 21, is supported horizontally solely by hinges 202 and 204 at about mid height of uprights 206, 208. Platform 210 is pivotable in a counterclockwise direction upwardly as viewed in FIG. 21 to a fully closed position shown in front elevation in FIG. 23 wherein the bottom surface 212 of platform 210 becomes flush with the surrounding margin of frame 200. A handle 213 is mounted to undersurface 212 near its upper edge to facilitate manipulation of seat platform 210 in opening and closing of the same.

FIGS. 22 and 24 illustrate the port side four-bar hinge assembly 202 of the invention mounted to mock frame support 206 in the completely folded-down position (FIG. 22) and in the fully folded-up position (FIG. 24). Likewise, FIGS. 25 and 27 show the starboard side seat hinge assembly 204 in the completely folded-down position (FIG. 25) and in the completely folded-up position (FIG. 27), hinge assembly 204 being shown by itself in these views. FIG. 26 is an engineering line drawing scaled to illustrate relative dimensional values (also incorporated herein by reference from the aforesaid provisional application Ser. No. 60/295,861) of the starboard four-bar hinge assembly 204 in both horizontal and folded-up conditions. FIGS. 28, 29, 30 and 31 show sequentially the relative position of the brackets and links of the starboard hinge assembly 204 (shown by itself) as it is articulated through the completely folded-down position of FIG. 28 to the partially folded-up position of FIG. 29 (wherein the seat bracket is inclined about 45° from horizontal), then FIG. 30 where the seat is articulated and further pivoted upwardly (to about a 70° angle from horizontal), and finally fully folded up in FIG. 31. Each of the port and starboard hinge assemblies 202 and 204 are made up of identical components rearranged as necessary to accommodate port versus starboard mounting. The individual brackets and links of the port and starboard hinge assemblies are shown in FIGS. 32-A through 32-F.

Referring more particularly to FIGS. 32-A through 32-F, each seat hinge assembly 202 and 204 comprises a right angle mounting bracket 214 (FIGS. 32-A and 32-B); an angle frame mounting bracket 216 (FIGS. 32-C and 32-D); a bar hinge link 218 (FIGS. 32-E); and a control/locking bar link 220 (FIG. 32-F). Seat mounting bracket 214 has a link-connecting flange 222 and a seat-mounting flange 224. A pair of holes 226 and 228 are provided in flange 222 for receiving rivets 232 and 230 respectively therethrough for pivotal connection thereto of the swinging ends of hinge link 218 and control link 220 respectively. Flange 224 also has a pair of holes 234 and 236 therethrough for receiving threaded fasteners (not seen) for attaching seat-mounting bracket 214 onto seat panel 210. The frame-mounting angle bracket 216 has a link-mounting flange 240 and a frame-mounting flange 242. Flange 240 has a pair of holes 244 and 246 therethrough for respectively receiving the rivet pivot pins 248 and 250 that pivotally connect the non-swinging ends of control link 220 and hinge link 218 to frame mounting bracket 216. Hinge link 218 (FIG. 32-E) has a pair of holes 252 and 254 therethrough that respectively receive rivet pivot pins 230 and 250 in assembly with seat-mounting bracket 214 and frame mounting bracket 216 respectively. Control/locking link 220 has a pair of holes 256 and 258 therethrough that respectively receive rivet pivot pins 248 and 232 respectively therethrough for pivotally connecting control link 220 to seat-mounting bracket 214 and frame mounting bracket 216 respectively.

It is to be noted that the port and starboard four-bar hinge assemblies 202 and 204 of the hidden seat assembly 198 of the invention employ the same stainless steel rivet pivot pins 86 (FIG. 18), stainless steel washers 130 (FIG. 19) and plastic spacer anti-friction washers 90 (FIG. 20) as the armrest four-bar hinge assemblies 64 and 66 of the first embodiment and hinge assembly 140 of the second embodiment, and are arranged in the same relative manner for performing the same functions. These rivet pins and washers are all standard items and hence contribute to cost reduction in construction of the armrest and hidden seat constructions of the invention.

In accordance with one further and principal feature of the hidden seat assembly 198 of the invention, and as will be seen in comparing FIGS. 21 and 22 with FIGS. 23 and 24, the seat mechanism can be folded from a horizontal sitting position upward into a very compact nested assembly in the folded position (FIG. 24) by specially contouring the non-swinging end of the control/locking link 220 and the swinging end of hinge link 218. Thus, referring to FIG. 32-E, the swinging end 260 of link 218 is provided with a notch in the form of a "S"-curve 262 that removes the corner that otherwise would be formed by the junction of end edge 264 and side edge 266 of link 218. Similarly, control/locking link 220 at its swinging end 268 (FIG. 32-F) is notched to remove the corner that otherwise would be formed by the projection of end edge 270 with side edge 272, i.e., by forming the notch along the "S"-curve line 274.

Referring to FIG. 26, when hinge link 218 swings from the horizontal position (solid lines) down to the retracted, folded-up position (phantom lines) the same can nest with its "S"-curve 262 nested with the complimental "S"-curve 274 of control/locking link 220 when it also is in its retracted, folded-up position (note that in FIG. 26 link 220 is shown with its bottom pivot hole shifted to the right, as viewed in FIG. 26, to a non-registering position with pivot hole 226 in mounting bracket 214 to simplify detail in this view). Thus, in the folded-down or collapsed position with the seatback raised to vertical, hidden position, the four-bar hinge assemblies 202 and 204 can fold up so that both mounting brackets 218 and 214 are almost parallel with one another, as best seen in FIGS. 27 and 31. This in turn results in the collapsed height or overall dimension of the hinge assemblies 202 and 204 in the collapsed position, as measured in the plane of pivotal motion and perpendicular to a line drawn through the pivot pins 250, 230 and 232, being only 2 inches when the four-bar hinge assemblies are dimensioned as set forth previously and to the scale shown in FIGS. 26 and 32-A–32-F.

It is also to be noted that the control/locking link 220 is provided with an angled edge 280 (FIGS. 26 and 32-F) that abuts edge 282 of hinge link 218 when the seat hinge assemblies 202 and 204 are articulated to the seat fully folded-down position to thereby support and lock the seat against vertical downward loading in this position, similar to the lock-up of the four-bar hinge assemblies 64, 66 and 140 of the first and second embodiments in the armrest fully folded-down position.

From the foregoing description, it will now be seen that the hidden seat assembly 198 of the invention makes it possible to store the seat cushion that is upholstered onto the seat platform 210 (but not shown) against the wall associated with frame 200, as shown in FIG. 23, when not in use. Then by grasping handle 213 it is an easy matter to pull the seat up and out to the fully lowered seating position to provide comfortable seating in this area. Hidden seat assembly 198 is thus a substantial space-saver in the limited space and confines normally found in watercraft. Hidden seat assembly 198 is also strong enough so that the clumsy, fold-down legs normally provided on fold-down seats can be eliminated. Because of its compact articulation and folding up into the frontal plane of frame 200, there is space for storage behind the seat platform 210, even with a cushion thereon, in the folded-up condition. In this fashion it becomes a double space-saver. The construction of hidden seat assembly 198 also is such that it can be used for a single seat or for bench seating. In the exemplary embodiment shown, the dimensions are such that seat 210 can fit into a 24 inch high wall area, and when the frame 200 is mounted with its lowermost position at floor level, the seat will fold out to a height of about 16 inches above the floor level or cabin sole area.

From the foregoing description and drawings incorporated by reference herein, it also will now be evident to those of ordinary skill in the art that the fold-up marine furniture components with articulated bracket supports of the invention amply fulfill the aforestated objects and provide many advantages and features over the prior art. All of the components cooperate as designed for use in the marine environment with marine-grade non-corrosive and water-resistant coatings, preferably powder-coat paint, and with link and bracket materials made from aluminum and stainless steel, and fasteners made of stainless steel or rivets made of aluminum. The design is thus unique and advantageous over prior art automotive type armrest four-bar hinge assemblies in that it allows the use of common, lower cost materials, typically common straight aluminum bar stock and common aluminum angle stock. Standard rivet fasteners are also used throughout. The costly expense of providing blanking, stamping and bending progressive dies is eliminated because only low cost tooling is required to manufacture the four-bar hinge assemblies of the invention. Typically, all that is needed for shaping the end curves of the links is a radius cut die punch tooling. The holes in the brackets and links can be made by inexpensive unit punch tooling. Alternatively, CNC machining can be used, which is still inexpensive compared to progressive die tooling.

The first embodiment armrest hinge assembly and method of constructing the same with the armrest frame provides a unique method of mounting of the four-bar hinge assembly to the armrest frame that substantially reduces the cost of installation of the same to the armrest. First upholstering the armrest and then attaching each hinge assembly 64, 66 by screw-fastening straight-link armrest bracket 76 to the armrest, with panel mounting bracket 70, and hinge and control links 72 and 74 already operably attached to armrest bracket 76, eliminates many problems and costs of the prior method. The large diameter rivets 86 provide a large surface area at the pivot points where they bear against the ⅛ inch thick material of the aluminum extrusion. This larger diameter of the rivet shaft prevents distortion in the aluminum material of the rivet hole which might otherwise occur if the rivets were made too small.

Although rivets 86 are large size and are used throughout for both reduced costs and increased strength, the resultant large heads on these rivets are accommodated by use of the spacer-washers 140 preferably strategically placed so that the rivet heads in the first three embodiments will not rub on the links or angle brackets. Where the links and brackets swing close to one another, the Mylar or polyester washers 130 are used to minimize friction. Preferably washers 130 are made of Mylar plastic material so that they can be made thinner and stronger than would be the case with other types of plastic material used for this purpose.

It also will be best seen from FIGS. 25 and 28, when the seat hinge assemblies are in their folded-down, seating position, the abutment region of the locking link edge 280 with the hinge link edge 282, which otherwise represents a potential pinch point, is safely hidden between the link flange 222 of a seat-mounting angle bracket 214 and the flange 240 of seat-mounting angle bracket 216. The abutment point where these links meet is thus placed so that it is not accessible, the linkage avoids a potential pinch point for user's fingers.

Fourth Embodiment

FIGS. 33–41 illustrate a fourth embodiment of a four-bar hinge assembly and a support member in the form of another fold-down armrest of the invention. FIGS. 34, 35 and 36 are side and frontal perspective views of a prototype mock-up chair back assembly 300 utilizing a pair of the fourth embodiment port and starboard four-bar hinge assemblies 324 and 326 mounted to a mock-up of a chair seatback having a back panel 302 (assumed with a forward facing orientation in the watercraft) and a port side wing panel 304 and a starboard side wing panel 306. Pivotal articulation support of port and starboard armrest frames 308 and 310 respectively from wing panels 304 and 306 is provided by fourth embodiment four-bar hinge assemblies 324 and 326.

Armrest frames 308 and 310 are shown in their non-upholstered condition in FIGS. 34–36 and each contain a flanged cup holder 312 and 314 drop-mounted therein. Port armrest 308 comprises a top panel 316 supporting the cup holder 312 in a hole in the top panel, and a single side panel 318 fastened to the undersurface of the inboard side edge of top panel 316 and vertically dependent therefrom such that top panel 316 is cantilever supported by side panel 318. Likewise, starboard armrest frame 310 has a top panel 320 supporting its cup holder 314, and a single side panel 322 dependent from the undersurface of top panel 320 at its inboard side edge and cantilever supporting top panel 320.

Chair 300 also includes modified port and starboard four-bar hinge assemblies 324 and 326 providing four-bar hinge articulation support for the port and starboard armrests 308 and 310 respectively from the side wing panels 304 and 306 of seat 300. Hinge assemblies 324 and 326 are made up of identical components but reoriented as required to accommodate the respective port and starboard mountings. FIG. 33 illustrates, in engineering line drawing and semi-diagrammatic format, the starboard hinge assembly 326 shown by itself in its two extreme limit positions, the armrest folded-down position corresponding to that of FIG. 35 being shown in solid lines and the armrest folded-up position corresponding to that of FIG. 36 being shown in broken lines.

The four individual components of each hinge four-bar assembly 324 and 326 are shown in FIGS. 37 through 41. Each hinge assembly thus comprises a hinge long link 328 similar to link 72, a control/locking link 330 similar to control/locking link 74, an armrest mounting bracket 332 similar to bracket 76, and a seat-mounting bracket 334 that performs the function of seat-mounting bracket 70 but is structurally dissimilar in that bracket 334 is a straight planar piece without flanges. Hence, unlike any of the first three embodiments, no angle stock is employed in any of the four components of hinge assemblies 324 and 326. Armrest mounting bracket 332 is provided with three rivet holes 336, 338 and 340 (FIG. 39) to render the link universal for port and starboard mounting as in the case of armrest bracket 142 described previously. Seat mounting bracket 334 is provided with two rivet holes 342 and 344 and three countersunk holes 346, 348 and 350, arranged and dimensioned to scale as shown in FIG. 40 (FIGS. 37–41 are engineering scale views with relative dimensional values shown in the aforesaid provisional application Ser. No. 60/295,861 and therefore incorporated by reference in toto herein).

Preferably armrest 300 is constructed in accordance with the aforementioned novel method of the invention wherein seat assembly wing panels 304 and 306 are each provided with mounting through-holes for the Phillips head screws (like screws 98 and 100) that are first inserted through screw holes 346 and 350 of bracket 334 in assembly, and likewise provided with the pre-mounted T-nuts at the inboard sides of these holes (similar to T-nuts 110 and 112) in the manner of side panels 54 and 56 of armrest frame 50 described previously. The port and starboard armrest frames 308 and 310 are likewise provided with a pair of through-mounting screw holes and associated T-nuts. Then the seatback 302 and wing panels 304 and 306 are upholstered and suitable openings left in alignment with the associated screw fastener holes in side panels 304 and 306 respectively. Likewise, armrest frames 308 and 310 are upholstered, and registering access openings left in the upholstery covering the inboard sides of side panels 318 and 320 registering with the associated screw fastener holes therein. Each of the port and starboard hinge assemblies 324 and 326 is made up as a complete pin-coupled subassembly with the rivet pivot pins 86 extending through the registering holes 338 of bracket 332 and 360 of link 328 to connect the swinging end of link 328 to bracket 332. Another rivet pin 86 extends through rivet pin hole 344 of seat-mounting bracket 334 and through the other rivet pin hole 362 of link 328 to thereby pivotally mount the stationary end of link 328 to mounting bracket 334. Another rivet pin 86 extends through the pin hole 342 of seat-mounting bracket 334 and the registering hole 364 of control link 330 to thereby pivotally mount control link 330 on seat-mounting bracket 334. The swinging end of link 330 is connected by another rivet pin 86 extending through pinhole 366 at the swinging end of link 330 and through the registering hole 340 of armrest mounting bracket 332.

The port and starboard four-bar hinge sub-assemblies 324 and 326 can then be chair-mounted to the pre-upholstered seatback components, preferably by first attaching brackets 334 one to each of the seatback side wing panels 304 and 306. Phillips head screws are inserted through screw holes 346 and 350 in each bracket 334 and into the registering openings in associated wing panels 304 and 306, followed by threading and tightening of the screws in the associated T-nuts. The mounting screws access the pre-formed mounting holes in side wings 304 and 306 through the aforementioned die cut openings in the fabric of the upholstery provided in the upholstering process. Preferably, when mounting brackets 334 are tightened down against the upholstery they squeeze it against the outer sides of the side wings 304 and 306.

Then each of the pre-upholstered armrests 308 and 310 can be respectfully mounted to its associated support four-bar hinge sub-assembly 324 and 326 by first aligning the pre-formed holes in side panels 318 and 322 with the screw fastener holes in armrest mounting bracket 332 of these four-bar hinge sub-assemblies. Then these associated fastener screws are inserted through bracket openings 370 and 372 (FIG. 39), thence through the precut holes in the upholstery fabric, and thence through the pre-formed holes in the side panels 318, 322 until the threaded ends of the fasteners register with or are threaded into the associated pre-mounted T-nuts. As the screws are tightened down, the armrest mounting brackets 332 are tightly clamped against the upholstery fabric which is thus squeezed between the bracket and the side face of the side panel.

The motion of the hinge parts in operation of four-bar hinge assemblies 324 and 326 can be visualized from analysis of the limit positions shown in solid lines and broken lines in FIG. 33.

It thus will be understood from the foregoing description that the fourth embodiment seat construction 300 advantageously employs many of the features of the previously described embodiments including the flat bar-type armrest mounting bracket 332 that, like bracket 76, allows surface mounting of the hinge assembly to the armrest after the armrest is upholstered. Again, this allows the armrest (and also the seatback assembly 302) to be upholstered separately and married up at final assembly, thereby saving labor costs. The provision of the flat seat-mounting bracket 334 enables the same type of procedure to be employed relative to the pre-upholstering of seatback components 302/304/306. Thus, in seat assembly 300, both hinge-mounting brackets 332 and 334 are flat instead of angle pieces. This allows surface mounting of both of these hinge-mounting brackets, with both brackets mounting over upholstery. As before, this lowers both the upholstering and assembly costs. It also allows the armrest and chairs to be built and shipped separately.

In accordance with another feature of chair assembly 300, the armrests are "single mount" armrests rather than dual mount, as in the case of armrest 40. The armrest frames 308 and 310 have only one side panel 318 and 322 respectively, as contrasted with the two side panels 54 and 56 of frame 50 of armrest 40. In order to make the armrest four-bar hinge assembly strong enough so that only one hinge assembly is capable of supporting the entire armrest, the thickness of the hinge brackets and links is increased, e.g., preferably to 3/16 inch thick, as shown to scale in FIGS. 37–41. Advantageously, this is the next readily available commercial stock thickness above 1/8 inch, and it was found to work well. It does not flex excessively from side to side under test loading. It also was found that this increase in metal thickness of the four hinge assembly components not only stiffened the link arms to reduce flexure but also increases the operative bearing length of the rivet shank. This increase in rivet length under both the head and clenched ends creates a longer axle length that helps stiffen the 11 pivot points in the assembly.

As another feature of seat 300 the extruded aluminum bar stock to make the seat-mounting bracket 334 was chosen to be the commercially available "obround" type aluminum extrusion wherein the parallel longitudinal edges 38 and 382 of bracket 334 are rounded so as to be semi-circular in transverse cross section, as shown in FIG. 41. This full round corner edge on each of the longitudinal edges was found to then allow the use of the rivet head of the rivets mounted in hole 360 of link 328 and the rivet head of the rivet mounted in hole 340 of armrest bracket 332 to establish as an interference overlap fit for producing a friction lock in both the fully folded-out position shown in solid lines in FIG. 33 and in the stowed position of the hinge assembly shown in broken lines in FIG. 33.

To accomplish this friction lock action one of the two shim washers was removed to narrow the operative gap between the facing surfaces of seat-mounting bracket 334, control link 330 and armrest mounting bracket 332. Thus, when link 330 moves toward its lock-up position shown in solid lines in FIG. 33, due to the rounded or bullet nose hemispherical head of the rivet joining link 330 to bracket 332, and due to the rounded edge 380 of bracket 334, when the rivet head encounters bracket edge 380 the rivet head smoothly cams over the edge 380 and then slides against the facing surface of bracket 334 as link 330 reaches its locked-up position shown in solid lines in FIG. 33. This imparts a separational stress between the overlapped links and brackets that tends to keep the armrest in locked-up condition in this fully folded-out relationship. The friction lock up also tightens up clearances and thereby prevents rattling of the hinge assembly, as when the watercraft is vibrated during travel by wave action.

Likewise, when hinge assembly 326 is folded down to store the armrest, thereby placing the links and bracket 332 in the broken line positions shown in FIG. 33, the rivet head of the pin mounted through link openings 338 and 360 encounters edge 380 and then is disposed with a squeeze fit between the overlapping facing surfaces of bracket 334 and link 330. Again, this travel end limit action tends to hold the hinge-articulated assembly in the folded-up position, while also tending to stress the hinge parts and thereby take up clearances to prevent noise in the assembly otherwise resulting from watercraft vibration.

From the illustrative embodiments described and illustrated hereinabove, it will be appreciated that the four-bar hinge assemblies for marine armrests and hidden seat constructions are adaptable to different mounting configurations, as will be evident to those skilled in the art from the foregoing disclosure. It will also now be evident from the foregoing disclosure that the four-bar hinge assemblies of the invention may be advantageously used in providing articulated support for stowable tables and countertops installed in various types of watercraft as well as for similar usages and applications in other harsh environments.

What is claimed is:

1. A four-bar hinge linkage and fold-down armrest assembly for marine use in watercraft seating applications, comprising a frame made up of a platform board and two laterally spaced sideboards dependent therefrom with their longitudinal dimension running parallel to that of said platform, said frame being adapted to be pivotally supported for four-bar hinge articulation from a stationary upright back panel board of a boat bench seat, sofa or the like, said articulation being provided by first and second four-bar hinge linkages, each of said hinge linkages comprising a four-bar linkage made up of a right angle board-mounting bracket, a main hinge link, a shorter control and locking link and an armrest mounting bracket, said right angle board-mounting bracket having one of its flanges adapted to be secured by screws to the seatback panel, the other flange of said right angle board-mounting bracket being adapted to provide a stationary pivot mount for one end of said hinge link and for one end of said control/locking link, said armrest mounting bracket of each said hinge linkage being secured to the outboard side of an associated sidewall of said frame by mounting screws that pass through holes in said armrest mounting bracket and thence through a spacer washer, thence through preformed holes in said sidewall and into a pre-mounted standard T-nut, said armrest mounting bracket providing a pivot connection of said links to said armrest frame by pivot pin rivets mounted in said armrest mounting bracket and passing individually through associated holes one in the swinging end of each of said links, whereby said four-bar hinge linkages, in articulating said armrest between an upright stored position and a fully folded-down in-use position, are operable such that in the fully folded down in-use position of said armrest the swinging end of said control/locking link swings up and beneath said hinge link so that in the armrest fully folded-down in-use position an inclined end edge of said control link abuts in line-to-line linkage-locking contact the underside edge of said hinge link, such that in this condition, each said linkage is locked together to each form a triangular support truss, and wherein the placement of the abutment locking point in each linkage is such that each said linkage is locked together with said abutment at a point along said hinge link where it provides a strong support structure, does not create a user pinch point and such locking point is oriented well forward of the linkage pivot point so said links will not push by one another.

2. The assembly as set forth in claim 1 and further including one or more washers employed to take up the extra spacing between a peened end of a rivet head of said pivot pin rivets and the side of said armrest mounting bracket when using pivot pins all of the same length and diameter, said washer being sleeved on each rivet pin between said board-mounting bracket flange and each of the associated hinge links in order to space these links sufficiently from the side of said flange to allow swinging clearance for the heads of said rivets.

3. The assembly as set forth in claim 2 and further including thin Mylar washers sleeved one apiece on said rivet pins between said links and said armrest bracket to thereby reduce rubbing friction and wear between such links and said armrest bracket.

4. The assembly as set forth in claim 3 wherein said pivot pins are all identical and are standard 5/16 inch diameter stainless steel rivets, and wherein stainless steel backup washers are strategically placed to provide sufficient strength and to eliminate rubbing of the moving parts of each said hinge assembly, and wherein thin plastic washers, either made of polyester or Mylar material, are used on the pivot points to minimize friction.

5. The assembly as set forth in claim 1 wherein said links are made from standard aluminum bar stock on the order of 0.125 inches thick and about 1 inch wide, wherein said mounting angle bracket is made from standard aluminum extruded angle bar stock on the order of 0.125 inches thick and with equal flange widths of about 1.5 inches, wherein said armrest bracket bar is a standard aluminum flat bar stock piece likewise on the order of 0.125 inches thick and about 1 inch wide, and wherein said standard aluminum bar and extrusion link and bracket hinge parts are powder-coat painted to further resist corrosion in a marine environment, the lubricity of such powder coat paint finish as compared to non-anodized aluminum material making the linkage and pivot points work smoother and quieter.

6. The assembly as set forth in claim 5 wherein the powder coat paint is applied over an anodized aluminum finish on said linkage parts.

7. The assembly as set forth in claim 1 wherein said hinge bracket parts and said hinge link parts are die punched to form the through-holes located in precision relationship and spacing by utilizing unit punch tooling.

8. A pivotal boat seat assembly utilizing a four-bar hinge linkage to provide a pivotal seat that becomes a hidden seat mechanism in a surrounding seat frame in the associated watercraft, said boat seat assembly comprising first and second four-bar hinge linkages adapted to be mounted to inside surfaces of a pair of horizontally spaced uprights of a seat frame of the watercraft, a pivotal hidden seat main platform that, in a fully lowered seating position thereof, is supported generally horizontally solely by said hinge linkages, said platform being pivotable upwardly to a fully closed position wherein the bottom undersurface of said platform becomes an upright exterior surface flush with the surrounding margin of the seat frame, a handle mounted to said platform undersurface near its upper edge to facilitate manipulation of said seat platform in opening and closing of the same, and wherein each of said seat hinge linkages comprises a right angle seat platform mounting bracket, a right angle frame mounting bracket, a bar hinge link and a bar control/locking link, said seat platform mounting bracket having a link-connecting flange and a seat-mounting flange, said link-connecting flange having a pair of holes for receiving rivets individually therethrough for pivotal connection thereto of the swinging ends of said hinge link and said control link respectively, said seat mounting flange of said mounting bracket also having a pair of holes therethrough for receiving threaded fasteners for attaching said seat-mounting bracket onto seat said platform, said frame-mounting angle bracket having a link-mounting flange and a frame-mounting flange, said link-mounting flange having a pair of holes therethrough for respectively individually receiving an associated one of a first pair of rivet pivot pins that pivotally connect the non-swinging ends of said control link and said hinge link to said frame mounting bracket, said hinge link having a pair of holes therethrough that respectively individually receive an associated one of a second pair of rivet pivot pins in assembly with said seat-mounting bracket and said frame mounting bracket respectively, said control/locking link having a pair of holes therethrough that respectively individually receive an associated one of a third pair of rivet pivot pins for pivotally connecting said control link to said seat-mounting bracket and said frame mounting bracket respectively, said pivotal boat seat assembly being constructed and arranged to be folded from a generally horizontal sitting position upwardly into a very compact nested assembly in the folded position by specially contouring the non-swinging end of said control/locking link and the swinging end of said hinge link, the swinging end of said hinge link having a notch in the form of a "S"-curve that removes the corner that otherwise would be formed by the junction of an end edge and a side edge of said hinge link, similarly, said control/locking link at its swinging end having a notch in the form of an "S"-curve that removes the corner that otherwise would be formed by the projection of an end edge with a side edge of said control/locking link, such that when said hinge link swings from a horizontal position down to its retracted, folded-up position, the same can nest with its "S"-curve nested with the complimental "S"-curve of said control/locking link when it also is in its retracted, folded-up position, whereby in the folded-down or collapsed position, with the seatback raised to its generally vertical, hidden position, said four-bar hinge linkages fold up so that both mounting brackets are almost parallel with one another, thereby resulting in the collapsed height or overall dimension of said hinge linkages in their collapsed position, as measured in the plane of pivotal motion and perpendicular to a line drawn through said pivot pins, being in the order of only the corresponding dimension of the adjacent flange of said frame mounting bracket, said control/locking link being provided with an angled end edge that abuts a lower side edge of said hinge link when said seat hinge linkages are articulated to their fully folded-down seating position to thereby support and lock the seat against vertical downward motion when loaded in this position.

9. The pivotal boat seat assembly of claim 8 wherein said hinge assemblies are constructed and arranged such that when said seat hinge assemblies are in their folded-down, seating position, the abutment region of said control/locking link end edge with said hinge link lower edge, which otherwise represents a potential pinch point, is safely hidden between said seat-mounting angle bracket and said frame-mounting angle bracket, whereby the abutment point where these links meet is thus placed so that it is not easily accessible, the linkage thereby avoiding potential linkage lock-up abutment pinch points for user's fingers.

10. A chair back assembly for marine watercraft use utilizing first and second fold-up chair arm frames respectively articulated by first and second four-bar hinge linkages mounted to a chair seatback having a back panel and a first wing panel and a second wing panel, and wherein pivotal articulation support of said first and second chair arm frames is by respective cantilever support from said chair seatback via said first and second wing panels and said four-bar hinge linkages mounted on said wing panels, said arm frames containing a flanged cup holder top-mounted therein, each said arm comprising a top panel supporting the associated cup holder in a hole in the top panel, and a single side panel fastened to the undersurface of the inboard side edge of said top panel and vertically dependent therefrom such that said top panel is cantilever supported by said side panel, said first and second four-bar hinge linkages being operable for providing four-bar hinge articulation support for said first and second arms from the associated side wing panels of said seatback for pivotal motion of said arms between a fully folded-up upright stored position and a fully folded-down in-use lock-up position, each said hinge assembly comprising a flat bar hinge long link, a flat bar control/locking link, a flat bar arm mounting bracket, and a flat bar seat-mounting brackets whereby said four-bar hinge linkages, in articulating said armrest between the fully folded-up upright stored position and the fully folded-down in-use lock-up position, are operable such that in the fully folded-down in-use position of said armrest the swinging end of said control/locking link swings up and beneath said hinge link so that in the armrest fully folded-down in-use position an inclined end edge of said control link abuts in line-to-line linkage-locking contact the underside edge of said hinge link, such that in this condition, each said linkage is locked together to each form a triangular support truss and wherein the placement of the abutment locking point in each linkage is such that each said linkage is locked together with said abutment at a point along said hinge link where it provides a strong support structure does not create a user pinch point and such locking point is oriented well forward of the linkage pivot point so said links will not push by one another.

11. The chair back assembly of claim 10 wherein said chair arms are "single mount" armrests, each said armrest having a frame with only said one side panel, said associated four-bar hinge linkages being made strong enough so that only one hinge assembly is capable of supporting the entire armrest under rated load, the thickness of said hinge brackets and links being preferably about 3/16 inch.

12. The chair back assembly of claim 11 wherein the extruded aluminum bar stock to make said seat-mounting bracket comprises the commercially available "obround" type aluminum extrusion wherein the parallel longitudinal edges of said bracket are rounded so as to be semi-circular in transverse cross section, and wherein a rivet head of a rivet mounted in a hole of said long link and a rivet head of a rivet mounted in a hole of said bracket are constructed and arranged to establish an interference overlap fit for producing a friction lock in both the fully folded-down in-use lock-up position and in the fully folded-up stored position of said hinge assemblies, such friction lock action being created by narrowing by design the operative gap between the facing surfaces of said seat-mounting bracket, said control link and said arm mounting bracket, whereby when said control link moves toward its fully folded-down in use lock-up position, due to the rounded or bullet nose hemispherical head of the rivet joining said control link to said arm mounting bracket, and due to the rounded edge of said seat-mounting bracket, when the rivet head encounters said bracket edge the rivet head smoothly cams over the edge and then slides against the facing surface of said seat-mounting bracket as said control link reaches its locked-up fully folded-down in-use lock-up position, thereby imparting a separational stress between the overlapped links and brackets that tends to keep the associated said chair back arm rest in locked-up condition in this fully folded-down in-use lock-up position, thereby also tightening up clearances and thereby preventing rattling of said hinge linkages of said chair back assembly, as when the watercraft is vibrated during travel by wave action, and likewise, when said hinge linkages are folded up to store the associated arms, the rivet head of the pin mounted through a link opening in the swinging end of said control link encounters said rounded edge and then is disposed with a squeeze fit between the overlapping facing surfaces of said seat mounting bracket and said control link, this travel end limit action tending to thereby hold the hinge-articulated assembly in the folded-up stored position, while also tending to stress the hinge parts and thereby take up clearances to prevent noise in the assembly otherwise resulting from watercraft vibration.

13. A four-bar hinge linkage and fold-down support assembly for marine use in watercraft seating applications, comprising a support member adapted to be pivotally supported for four-bar hinge linkage articulation from a stationary upright support structure affixed to the watercraft, said articulation being provided by first and second four-bar hinge linkages, each of said hinge linkages comprising a four-bar linkage made up of a support-structure-mounting bracket, a main hinge link, a shorter control and locking link and a support-member-mounting bracket, said support-member-mounting bracket of each said hinge linkage being secured to an associated side of said support member, said support-member bracket providing a pivot connection of said links to said support member by pivot pin fasteners passing respectively through holes in the swinging ends of said links, said four-bar hinge linkages being constructed and arranged such that in articulating said support member between an upright stored position and a folded-down in-use lock-up position, the swinging end of said control/locking link swings up and beneath said hinge link so that in the fully folded-down in-use lock-up position of said support member an end edge of said control/locking link abuts in line-to-line contact the lower edge of said hinge link, whereby in this condition each said linkage is locked together to form a triangular support truss, and wherein said assembly is constructed and arranged, such that the placement of the abutment locking point in each said linkage is such that each said linkage is locked together at an abutment point that provides a strong support structure, reduces the possibility of creating a pinch point, and is oriented well forward of the linkage pivot point so that said links will not push by one another.

14. The assembly of claim 13 wherein extruded aluminum bar stock is used to make said support-structure-mounting bracket wherein the parallel longitudinal edges of said bracket are rounded so as to be semi-circular in transverse cross section, and wherein a rivet head of a rivet mounted in a hole of said main hinge link and a rivet head of a rivet mounted in a hole of said support-structure-mounting bracket are constructed and arranged to establish an interference overlap fit for producing a friction lock in both the fully folded-out position and in the stowed position of said hinge linkages, such friction lock action being created by narrowing by design the operative gap between the facing surfaces of said support-structure-mounting bracket, said control/locking link and said support-member mounting bracket, whereby when said control/locking link moves toward its fully folded-down in-use lock-up position, due to the rounded head of the rivet joining said control/locking link to said support-member mounting bracket, and due to the rounded edge of said support-structure-mounting bracket, when the rivet head encounters said rounded bracket edge the rivet head smoothly cams over such edge and then slides, against the facing surface of said support-structure-mounting bracket as said control/locking link reaches its fully folded-down in-use locked-up position, thereby imparting a separational stress between the overlapped links and brackets that tends to keep the associated support member in locked-up condition in this fully folded-down in-use lock-up position folded out relationship, thereby also tightening up clearances and thereby preventing rattling of said hinge linkages of said assembly, as when the watercraft is vibrated during travel by wave action, and likewise, when said hinge linkages are folded up to store the associated support members, the rivet head of the pin mounted through a link opening in the swinging end of said control/locking link encounters said rounded edge and then is disposed with a squeeze fit between the overlapping facing surfaces of said support-structure-mounting bracket and said control/locking link, this travel end limit action tending to thereby hold the hinge-articulated assembly in the folded-up position, while also tending to stress the hinge parts and thereby take up clearances to prevent noise in the assembly otherwise resulting from watercraft vibration.

15. The support assembly of claim 13 wherein in the folded-down in-use lock-up position of said support member said end edge of said control/locking link, when in line-to-line contact with the lower edge of said hinge link, is at least about 50% overlapped by one or both of said brackets to thereby assist in preventing user/operator finger pinching when lowering said support member into the fully folded-down in-use lock-up position thereof.

16. A method of constructing a four-bar hinge linkage and fold-down armrest assembly or other like support of the type comprising a four-bar hinge linkage and fold-down armrest assembly for marine use in watercraft seating applications, comprising a frame made up of a platform board and two laterally spaced sideboards dependent therefrom with their longitudinal dimension running parallel to that of said platform, said frame being adapted to be pivotally supported for four-bar hinge articulation from a stationary upright back panel board of a boat bench seat, sofa or the like, said articulation being provided by first and second four-bar hinge linkages, each of said hinge linkages comprising a four-bar linkage made up of a right angle board-mounting bracket, a main hinge link, a shorter control and locking link and an armrest mounting bracket, said right angle board-mounting bracket having one of its flanges adapted to be secured by screws to the seatback panel, the other flange of said right angle board-mounting bracket being adapted to provide a stationary pivot mount for one end of said hinge link and for one end of said control/locking link, said armrest mounting bracket of each said hinge linkage being secured to the outboard side of an associated sidewall of said frame by mounting screws that pass through holes in said armrest mounting bracket and thence through a spacer washer, thence through pre-formed holes in said sidewall and into a pre-mounted standard T-nut, said armrest mounting bracket providing a pivot connection of said links to said armrest frame by pivot pin rivets mounted in said armrest mounting bracket and passing individually through associated holes one in the swinging end of each of said links, whereby said four-bar hinge linkages, in articulating said armrest between an upright stored position and a folded-down in-use position, are operable such that in the folded-out down position of said armrest the swinging end of said control/locking link swings up and beneath said hinge link so that in the armrest fully folded-down position an inclined end edge of said control link abuts in line-to-line linkage-locking contact the underside edge of said hinge link, such that in this condition, each said linkage is locked together to each form a triangular support truss, and wherein the placement of the abutment locking point in each linkage is such that each said linkage is locked together with said abutment at a point along said hinge link where it provides a strong support structure, does not create a user pinch point and such locking point is oriented well forward of the linkage pivot point so said links will not push by one another, said method involving mounting of each hinge assembly to the support to thereby reduce the cost of installation of the hinge assembly to the support and overall cost of assembly of the support, said method comprising the steps of:

(1) providing the first and second armrest hinge brackets each as a straight bar link for through-bolting each to a support frame, but not until after upholstering the same, to thereby simplify the support upholstering and assembly procedure and thereby lower the manufacturing cost of the fold-down support and hinge assembly, (2) attaching the first and second straight bar armrest links to pre-upholstered associated sidewalls of said fold-down support with screws, (3) providing suitable access holes in the fold-down support upholstery to allow said screws to pass into and through pre-formed mounting holes in said sidewalls and then thread into associated pre-mounted T-nuts in said sidewalls, and (4) attaching the linkage, via the mounting brackets to mounting surface points on an associated stationary back panel before or after attaching said hinge assemblies to the upholstered support.

17. A method of constructing the chair back assembly of the type comprising the chair back assembly of claim 10 wherein said chair arms are "single mount" armrests, each said armrest having a frame with only said one side panel, said associated four-bar hinge linkages being made strong enough so that only one hinge assembly is capable of supporting the entire armrest under rated load, the thickness of said hinge brackets and links being preferably about 3/16 inch (set forth in claim 12) said method comprising the steps of:

(1) providing said wing panels with mounting through-holes for screws that are first inserted through screw holes of said seat mounting bracket in assembly, (2) providing pre-mounted T-nuts at the inboard sides of these said through-holes, (3) providing said first and second arms with a pair of through-mounting screw holes and associated T-nuts, (4) upholstering said seatback and wing panels with the upholstery being provided with suitable openings left in alignment with the associated screw fastener holes in said side panels, (5) upholstering said arms and providing registering access openings in the upholstery covering the inboard sides of side panels registering with the associated screw fastener holes therein, (6) assembling each of said first and second hinge assemblies as a complete pin-coupled subassembly with rivet pivot pins extending through registering holes of said arm mounting bracket and of said control link to thereby connect the swinging end of said hinge link to said arm mounting bracket, (7) providing another rivet pin through a rivet pin hole of said seat-mounting bracket and through the other rivet pin hole of said hinge link to thereby pivotally mount the stationary end of said link to said mounting bracket, (8) providing another rivet pin through a pin hole of said seat-mounting bracket and the registering hole of said control link to thereby pivotally mount said control link on said seat-mounting bracket, (9) connecting the swinging end of said control link by another rivet pin extending through a pinhole at the swinging end of said control link and through a registering hole of said armrest mounting bracket,

(10) then the four-bar hinge linkage sub-assemblies are chair-mounted to the pre-upholstered seatback components, preferably by first attaching brackets one to each of the seatback side wing panels,

(11) inserting screws through screw holes in each seat mounting bracket and into the registering openings in the associated wing panels,

(12) then threading and tightening of the screws in the associated T-nuts, the mounting screws accessing the pre-formed mounting holes in the side wings through the aforementioned access openings in the fabric of the upholstery provided in the upholstering process, and, when the mounting brackets are tightened down against the upholstery they squeeze it against the outer sides of the side wings,

(13) then each of the pre-upholstered arms are mounted to its associated support four-bar hinge sub-assembly by first aligning the pre-formed holes in side panels with the screw fastener holes in the associated arm mounting bracket of these four-bar hinge sub-assemblies,

(14) then these associated fastener screws are inserted through the bracket openings, thence through the precut holes in the upholstery fabric, and thence through the pre-formed holes in the side panels until the threaded ends of the fasteners register with or are threaded into the associated pre-mounted T-nuts; and,

(15) then as the screws are tightened down, the arm mounting brackets are tightly clamped against the upholstery fabric which is thus squeezed between the bracket and the side face of the side panel.

* * * * *

UNITED STATES PATENT AND TRADEMARK OFFICE

CERTIFICATE OF CORRECTION

PATENT NO. : 6,918,160 B1
DATED : July 19, 2005
INVENTOR(S) : Richard N. Clark

It is certified that error appears in the above-identified patent and that said Letters Patent is hereby corrected as shown below:

Column 5,
Line 31, before “control/locking link 74” delete “#”.

Column 15,
Line 42, after “that helps stiffen the” delete “11”.

Column 19,
Line 34, after “seat-mounting” delete “brackets” and insert -- bracket --.

Column 21,
Line 31, after “position” delete “folded out relationship”.

Signed and Sealed this

Thirty-first Day of January, 2006

JON W. DUDAS
*Director of the United States Patent and Trademark Office*